US006035500A

United States Patent [19]

Kawai et al.

[11] Patent Number: 6,035,500

[45] Date of Patent: Mar. 14, 2000

[54] BUCKLE

[75] Inventors: Yoshihiko Kawai; Yutaka Yamaguchi; Tadayuki Asako; Akihiro Shiota, all of Tokyo, Japan

[73] Assignee: Takata Corporation, Tokyo, Japan

[21] Appl. No.: 09/267,700

[22] Filed: Mar. 15, 1999

[30] Foreign Application Priority Data

Mar. 16, 1998 [JP] Japan ..... 10-065160
Jan. 18, 1999 [JP] Japan ..... 11-009731

[51] Int. Cl.[7] ..... A44B 11/26

[52] U.S. Cl. ..... 24/641; 24/633

[58] Field of Search ..... 24/640, 641, 639, 24/636, 629, 633, 615

[56] References Cited

U.S. PATENT DOCUMENTS

| | | | |
|---|---|---|---|
| 4,068,354 | 1/1978 | Loomba et al. | 24/641 |
| 4,391,024 | 7/1983 | Morinaga . | |
| 4,624,034 | 11/1986 | Ishiguro | 24/641 |
| 4,885,825 | 12/1989 | Kitazawa et al. . | |
| 5,014,401 | 5/1991 | Kitazawa | 24/641 X |
| 5,195,224 | 3/1993 | Bock et al. | 24/641 |
| 5,598,613 | 2/1997 | Feile et al. | 24/641 |
| 5,784,766 | 7/1998 | Downie et al. | 24/641 |

FOREIGN PATENT DOCUMENTS

| | | |
|---|---|---|
| 0 098 726 | 1/1984 | European Pat. Off. . |
| 0 384 703 | 8/1990 | European Pat. Off. . |
| 37 15 207 | 12/1987 | Germany . |

*Primary Examiner*—James R. Brittain
*Assistant Examiner*—Robert J. Sandy
*Attorney, Agent, or Firm*—Kanesaka & Takeuchi

[57] ABSTRACT

A buckle is formed of a base, a latch member supported by side walls of the base so that the latch member can pivot between its non-engaged position and its engaged position, an operational member manipulated to cancel an engagement between the tongue and the latch member; and a lock member. The latch member is biased to the engaged position, and pivots to the engaged position when a tongue is inserted into a predetermined position to engage the tongue. The lock member holds the latch member to the engaged position when the tongue and the latch member are engaged, and is able to be moved by the operational member to a position capable of canceling the engagement between the tongue and the latch member. The lock member is arranged to move only in the longitudinal direction of the buckle. Thus, the movement of the lock member is simplified to improve controlling ability of the latch member.

7 Claims, 25 Drawing Sheets

BUCKLE

BACKGROUND OF THE INVENTION

The present invention pertains to a technical field of a buckle used in a safety belt device such as a seat belt device provided for a seat of a vehicle such as an automobile.

Nowadays, in various vehicles including automobiles, seat belt devices for protecting occupants in emergency such as collision are mounted for seats thereof. In order to facilitate the occupant to wear on and off such a seat belt, a buckle is normally provided. In general, the buckle comprises a latch member provided with a joggle portion which latches a tongue wherein the latch member is biased by a spring in such a direction as to latch the tongue.

In this case, when the spring force against the latch member is set to be weak in order to reduce the operating force for releasing the engagement between the tongue and the buckle, the force for latching the tongue to the latch member is weak. On the other hand, when the spring force against the latch member is set to be strong in order to increase the force for latching the tongue to the latch member, the operating force required for releasing the engagement is increased.

Therefore, the buckle is provided with a lock member which prevents the displacement of the latch member during the engagement with the tongue, thereby enabling the minimization of the spring force against the latch member and thus reducing the operating force for releasing the engagement. This technique has been used conventionally. As one of buckles of such seat belt devices, a buckle is disclosed in Japanese Utility Model Unexamined Publication No. 60-139560. The buckle is illustrated in FIG. 21 where a tongue is not engaged with the buckle and illustrated in FIG. 22 where the tongue is engaged with the buckle.

As shown in FIG. 21 and FIG. 22, the buckle 1' comprises a base 2', a latch member 3' pivotally supported by the base 2', a lock member 4' mounted on an upper surface of the latch member 3' to control the pivotal movement of the latch member 3' such that the lock member 4' can move relative to and pivot with the latch member 3', an operational button 5' for manipulating the lock member 4' which is slidably disposed to the base 2', an ejector 6' slidably disposed on a bottom 2*c'* of the base 2', a latch spring 7' always biasing the latch member 3', a lock spring 8' always biasing the lock member 4', a button spring 9' always biasing the operational button 5', and an ejector spring 10' always biasing the ejector 6', and a casing 11'.

As shown in FIG. 23, the base 2' comprises a U-like frame having side walls 2*a'*, 2*b'* and the bottom 2*c'*. Both the side walls 2*a'*, 2*b'* are provided with shaft holes 2*d'*, 2*e'* and fan-shaped opening 2*f'*, 2*g'* formed therein, respectively. The shaft hole 2*d'* and the fan-shaped opening 2*f'* formed in one side wall 2*a'*, and, the shaft hole 2*e'* and the fan-shaped opening 2*g'* formed in the other side wall 2*b'* are positioned symmetrically about the longitudinal axis. The side walls 2*a'*, 2*b'* are provided with restraint projections 2*h'*, 2*i'* in positions around the fan-shaped openings 2*f'*, 2*g'*. The bottom 2*c'* of the base 2 is provided with an opening 2*j'* formed in the center thereof.

As shown in FIG. 21 and FIG. 22, secured to an end portion of the base 2' opposite to the end through which the tongue 12' is inserted is a spring holder 13' supporting the respective one ends of the springs 7', 9', 10'.

As shown in FIG. 24, the latch member 3' is formed symmetrically about the longitudinal axis and comprises shafts 3*a'*, 3*b'* which are inserted in and supported by the shaft holes 2*d'*, 2*e'* of the side walls 2*a'*, 2*b'*, respectively, a joggle portion 3*c'* which can be latched to a latch hole 12*a'* of the tongue 12', shoulder portions 3*d'*, 3*e'* which can pivot in the fan-shaped openings 2*f'*, 2*g'*, through holes 3*f'*, 3*g'* formed in the shoulder portions 3*d'*, 3*e'* to which the restraint projections 2*h'*, 2*i'* can be inserted, respectively, a spring supporting and pressed portion 3*h'* which supports the other end of the latch spring 7' and is pressed by the operational button 5', and a spring supporting portion 3*i'* which supports one end of the lock spring 8'.

As shown in FIG. 25, the lock member 4' is formed symmetrically about the longitudinal axis and comprises control wings 4*a'*, 4*b'* which controls the closing motion of the through holes 3*f'*, 3*g'* of the latch member 3' in order to control the pivotal movement of the latch member 3', a spring supporting portion 4*c'* which supports the other end of the lock spring 8', and pressed portions 4*d'* which come in contact with the operational button 5' and are pressed by the operational button 5'.

As shown in FIG. 21, the operational button 5' comprises an operational portion 5*a'* which a seat belt user directly touches, a spring supporting and press portion 5*b'* which supports the other end of the button spring 9' and presses the spring supporting and pressed portion 3*h'* of the latch member 3', and a lock member press portion 5*c'* pressing the pressed portion 4*d'* of the lock member 4'.

The latch member 3' is always biased in the counter-clockwise direction $\alpha'$ about the shafts 3*a'*, 3*b'* by the latch spring 7' and the lock member 4' is always biased against the latch member 3' by the lock spring 8' in the longitudinal direction $\beta'$ of the latch member 3'. Further, the ejector 6' is always biased by an ejector spring 10' in such a direction $\gamma'$ of ejecting the tongue 12'.

In the buckle 1' as structured above, when the buckle 1' is in non-engaged state (where the tongue 12' is not engaged and not connected) as shown in FIG. 21, the control wings 4*a'*, 4*b'* of the lock member 4' are held in such positions that the wings 4*a'*, 4*b'* are in contact with side edges of the restraint projections 2*h'*, 2*i'* of the side walls 2*a'*, 2*b'* and do not close the through holes 3*f'*, 3*g'*, i.e. such position that the wings 4*a'*, 4*b'* are not in contact with the lower ends of the restraint projections 2*h'*, 2*i'*. Therefore, the latch member 3' is held in the state where the through holes 3*f*, 3*g'* are fitted onto the restraint projections 2*h'*, 2*i'*, the lower surface of the joggle portion 3*c'* of the latch member 3' is in contact with the upper surface of the ejector 6', and the joggle portion 3*c'* can not engage the latch hole 12*a'* of the tongue 12'.

In this state, as the tongue 12' is inserted into the buckle 1' in a direction $\delta'$ in order to connect the tongue 12' to the buckle 1', the ejector 6' is pressed by the end of the tongue 12' to move rearwardly and is displaced from the lower surface of the joggle portion 3*c'* of the latch member 3'. Therefore, the latch member 3' pivots in the counter-clockwise direction $\alpha'$ about the shafts 3*a'*, 3*b'* by the force of the latch spring 7' and the joggle portion 3*c'* latches to the latch hole 12*a'* of the tongue 12'. Thus, the tongue 12' engages and connects to the buckle 1' as shown in FIG. 22.

During this process, the rotational displacement of the latch member 3' is accompanied by the rotation of the control wings 4*a'*, 4*b'* of the lock member 4' in the counter-clockwise direction $\alpha'$, so the wings 4*a'*, 4*b'* are spaced apart from the side edges of the restraint projections 2*h'*, 2*i'*and move relative to the latch member 3' in the direction $\beta'$, i.e. in the longitudinal direction of the latch member 3'. The control wings 4*a'*, 4*b'*close the through holes 3*f'*, 3*g'* of the latch member 3' so that the lower ends of the restraint projections **2*h*', 2*i*' come in contact with the control wings 4*a*', 4*b*' and are thus prevented from entering into the through holes 3*f*', 3*g*'. As a result, even when abnormal impact is applied to the buckle 1', e.g. in case of a vehicle collision, since the upper surfaces of the control wings 4*a*', 4*b*' are in contact with the lower ends of the restraint projections 2*h*', 2*i*', the latch member 3' is limited not to pivot in the clockwise direction so that the latch member 3' is held in the engagement position. Consequently, the tongue 12' and the buckle 1'** are prevented from canceling the engagement therebetween.

For releasing the tongue 12' from the buckle 1', the operational portion **5*a*' of the operational button 5' is pressed in a direction ζ with a finger. Then, the lock member press portion 5*c*' of the operational button 5' comes in contact with the pressed portion 4*d*' of the lock member 4' and presses the pressed portion 4*d*'. Accordingly, the lock member 4' moves relative to the latch member 3' in the direction η' so that the wings 4*a*', 4*b*' are displaced from the through holes 3*f*', 3*g*' of the latch member 3' to open the through holes 3*f*', 3*g*', thereby allowing the restraint projections 2*h*', 2*i*' to enter into the through holes 3*f*', 3*g*'**.

As the operational button 5' is pressed in the direction ζ' further, the spring supporting and press portion **5*b*' comes in contact with the spring supporting and pressed portion 3*h*' and presses the spring supporting and pressed portion 3*h*' against the force of the latch spring 7'. The latch member 3' then pivots in the clockwise direction ε' so that the joggle portion 3*c*' is displaced upwardly to escape from the latch hole 12*a*' of the tongue 12' and the tongue 12' is pressed by the ejector 6' to move in the direction γ' and is thus released from the buckle 1'**.

At this point, the ejector 6' is positioned beneath the joggle portion **3*c*', so the release of the operational button 5' causes the operational button 5' to become in the inoperative position by the force of the latch spring 7' and the force of the button spring 9'. In addition, the latch member 3' pivots slightly in the counter-clockwise direction α' so that the lower surface of the joggle portion 3*c*' comes in contact with the upper surface of the ejector 6', thereby holding the latch member 3'** in the upper or non-engaged position.

In this way, the tongue 12' can be easily engaged with and released from the buckle 1'.

In this conventional buckle 1', however, the lock member 4' not only follows the pivotal movement of the shafts **3*a*', 3*b*' of the latch member 3' to pivot in the same directions (the directions α', ε') thereof but also moves linearly in the longitudinal directions of the latch member 3' (the directions β', η'). That is, the movement of the lock member 4' is complex. Even though the movement of the lock member 4' is complex, of course, the buckle must conduct the control of the latch member 3' by the lock member 4'. It is more desirable to simplify the movement of the lock member 4' as simple as possible. The simplification of the movement of the lock member 4' is preferable to improve the controllability of the latch member 3'**.

SUMMARY OF THE INVENTION

It is an object of the present invention to provide a buckle in which the movement of a lock member is simplified to improve the controllability of a latch member.

To accomplish this object, in a buckle comprising: a base having side walls; a latch member which is supported by the side walls so that the latch member can pivot between its non-engaged position and its engaged position, is biased to the engaged position, and pivots to the engaged position, when a tongue is inserted into a predetermined position, so as to engage the tongue; an operational member which is manipulated to cancel the engagement between the tongue and the latch member; and a lock member which holds the latch member to the engaged position when the tongue and the latch member are engaged and is able to be moved by the operational member to a position capable of canceling the engagement between the tongue and the latch member, the present in that the lock member is arranged to be allowed to move only in the longitudinal direction of the buckle.

In the present invention, the lock member comprises at least one restraint portion which is positioned beneath the latch member when the latch member is in the non-engaged position and is positioned above the latch member when the latch member is in the engaged position, wherein the restraint portion prevents the latch member from pivoting to the non-engaged position when the restraint portion is positioned above the latch member.

In the present invention, the latch member comprises a shaft which is inserted in and rotatably supported by the side walls; a joggle portion capable of engaging the tongue; and a pressed portion disposed between the shaft and the joggle portion which is subjected to biasing force to the engaged position.

In the present invention, the operational member comprises a first operational piece which is manipulated to move the lock member to the position capable of canceling the engagement between the tongue and the latch member; and a second operational piece which is disposed movably relative to the first operational piece to bias the pressed portion of the latch member to the engaged position of the latch member.

In addition, the present invention further comprises an elastic means disposed between the first operational piece and the second operational piece.

The present invention is further characterized by further comprises an inertia member which comes in contact with the lock member to restrict the lock member from moving to the position capable of canceling the engagement between the tongue and the latch member when the lock member is subjected to such acceleration as to move the lock member to the position capable of canceling the engagement between the tongue and the latch member.

In the present invention, the inertia member comprises an inertia lever which is rotatably disposed to the side walls of the base so that the inertia lever can rotate between a position where it restricts the lock member from moving to the position capable of canceling the engagement between the tongue and the latch member and a position where it allows the lock member from moving to the position capable of canceling the engagement between the tongue and the latch member.

In addition, in the present invention, the rotation of the inertia lever to move the lock member to the position capable of canceling the engagement between the tongue and the latch member is achieved by the operational member, the inertia lever is biased to rotate to the position allowing the lock member to move to the position capable of canceling the engagement between the tongue and the latch member by first torque which is produced by that the operational member presses the inertia lever with inertia force acting on the operational member by the acceleration, and the inertia lever is biased to rotate to the position restricting the lock member to move the position capable of canceling the engagement between the tongue and the latch member by second torque produced by inertia force acting on the inertia lever by the acceleration and the weight of the inertia lever, wherein the second torque is set to be larger than the first torque.

In the buckle as structured above according to the present invention, the lock member is designed to move linearly only in the longitudinal direction of the buckle during controlling the lock of the latch member. Therefore, the movement of the lock member is significantly simple and thus smooth as compared to the movement of the conventional lock member which both pivots and moves linearly. This improves the controllability of the latch member.

Though the position of the pressed portion of the latch member is changed between the non-engaged state and the engaged state, the change in the position is absorbed by the second operational piece. Therefore, the position of the first operational piece which the seat belt user directly touches is not changed.

Furthermore, though the lock member tends to move to the position capable of canceling the engagement between the tongue and the latch member when the lock member is subjected to acceleration, such as acceleration produced just after the actuation of the buckle pre-tensioner, which acts to move the lock member to the aforementioned position, the inertia member comes in contact with the lock member to restrict the movement of the lock member. Accordingly, even when the lock member is subjected to such acceleration, the disengagement between the buckle and the tongue can be securely prevented, thereby preventing the tongue from coming off the buckle due to the inertia caused by the actuation of the buckle pre-tensioner.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 1:
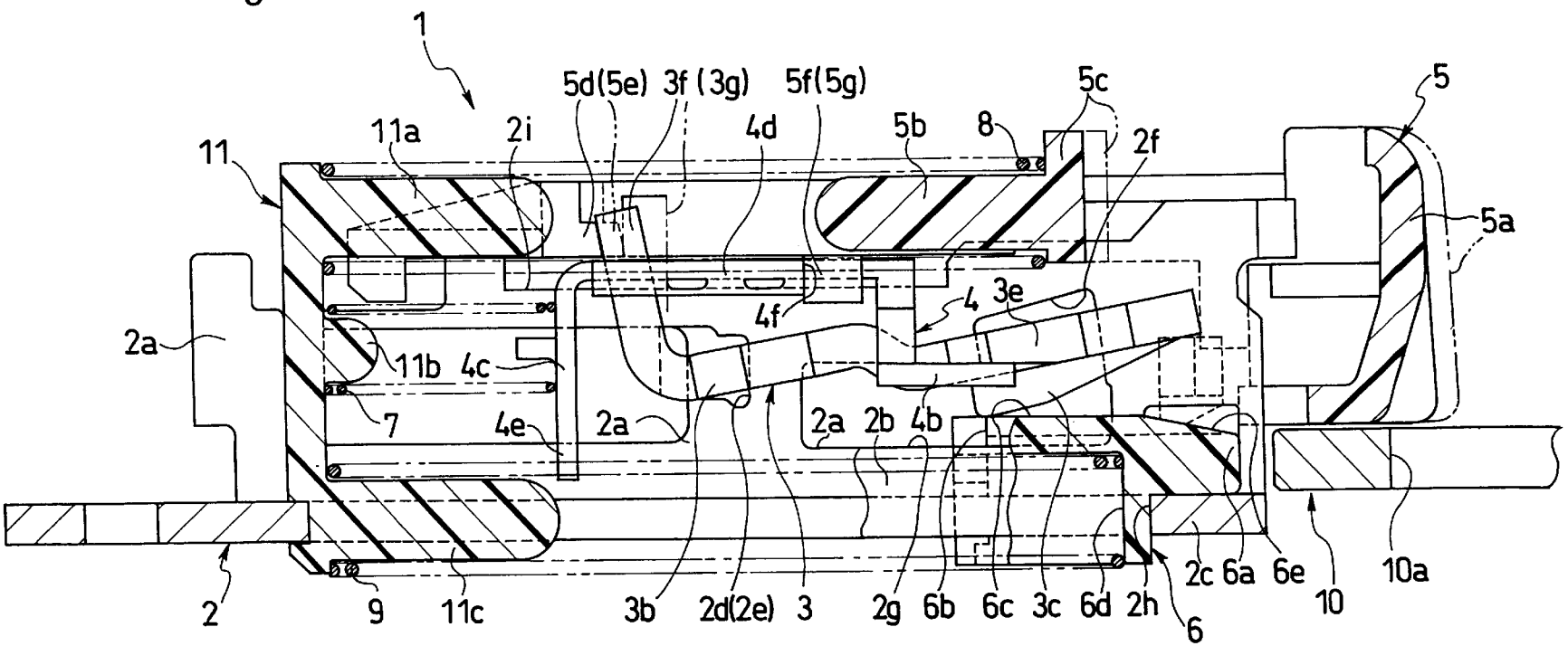
FIG. 1 is a partial sectional view showing a buckle of a first embodiment of the present invention, in its non-engaged state with a tongue.
Figure 2:
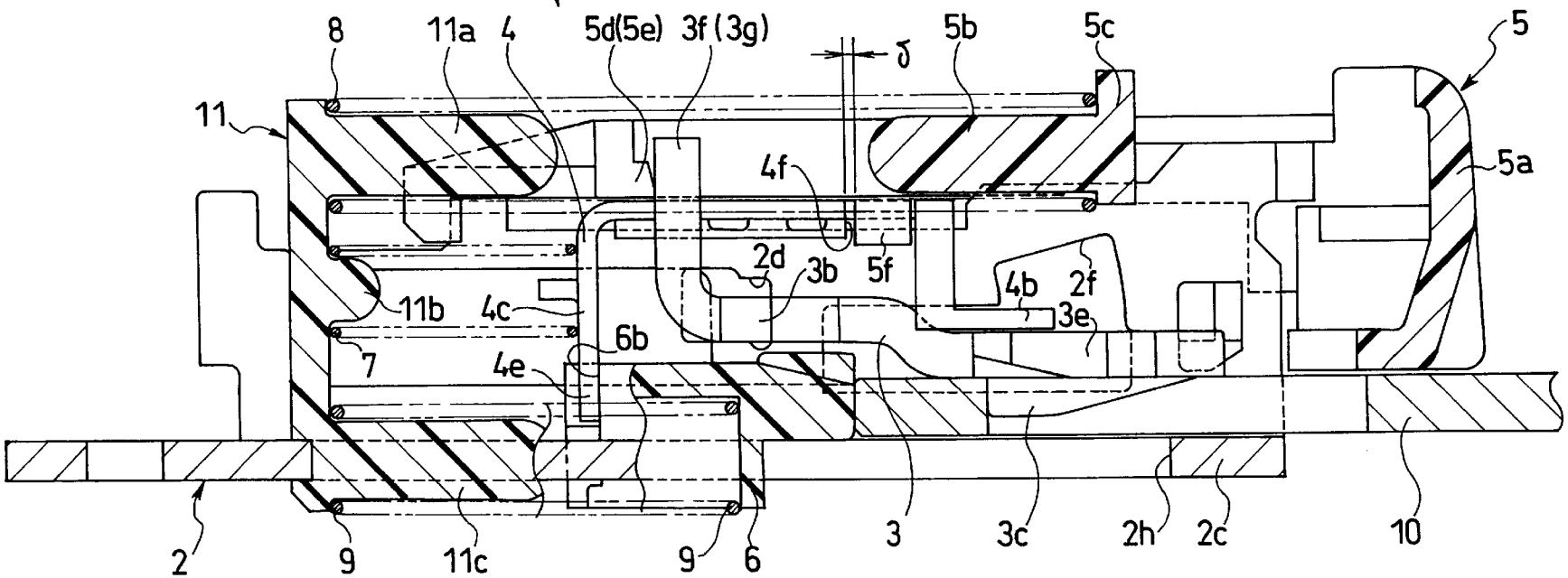
FIG. 2 is a partial sectional view showing the buckle of the first embodiment, in its engaged state with the tongue.
Figure 21:
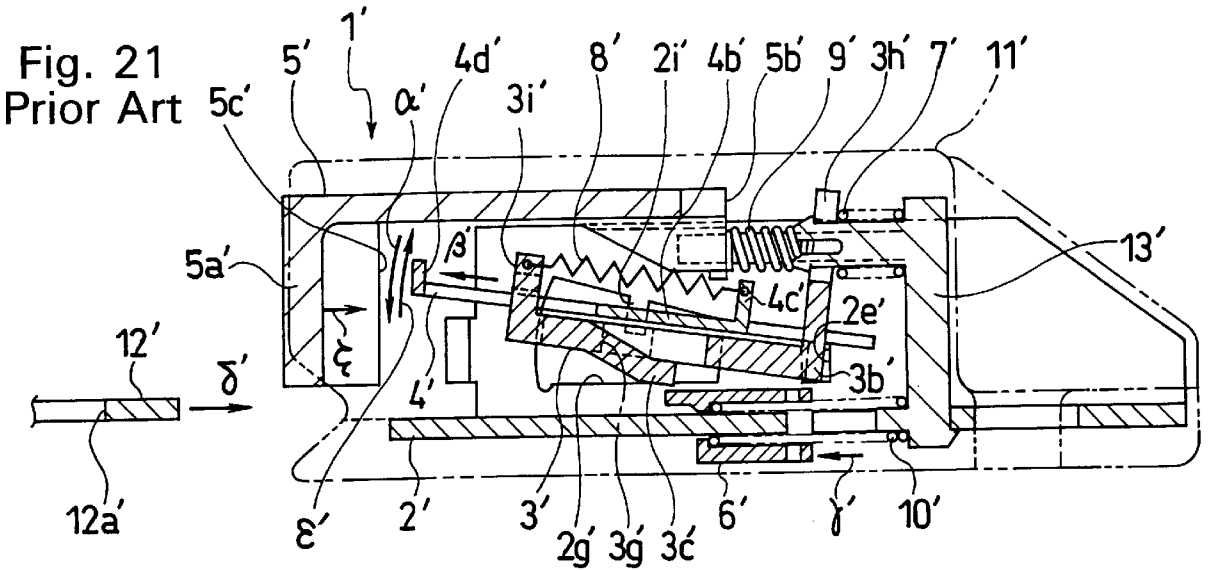
Fig. 21 Prior Art
FIG. 21 is a sectional view showing an example of conventional buckles in its non-engaged state with a tongue.
Figure 22:
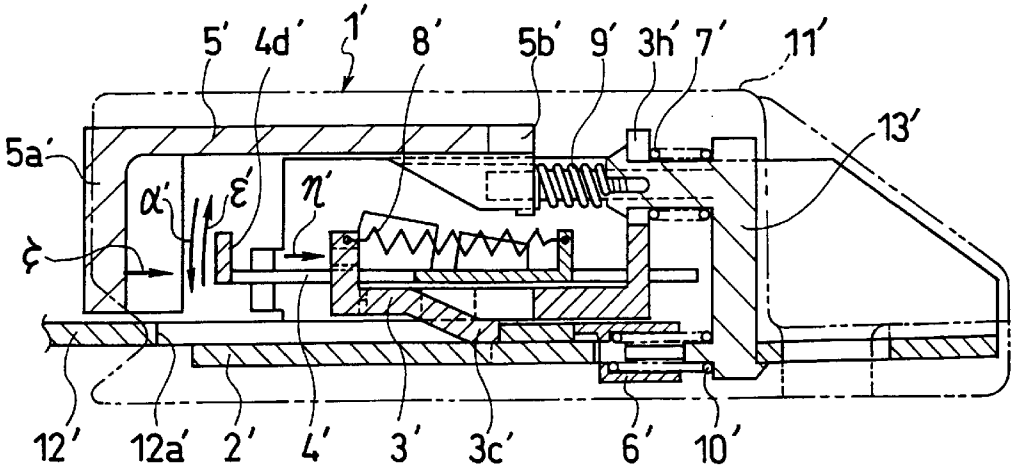
Fig. 22 Prior Art
FIG. 22 is a sectional view showing the buckle shown in FIG. 21 in its engaged state with the tongue.
Figure 23:
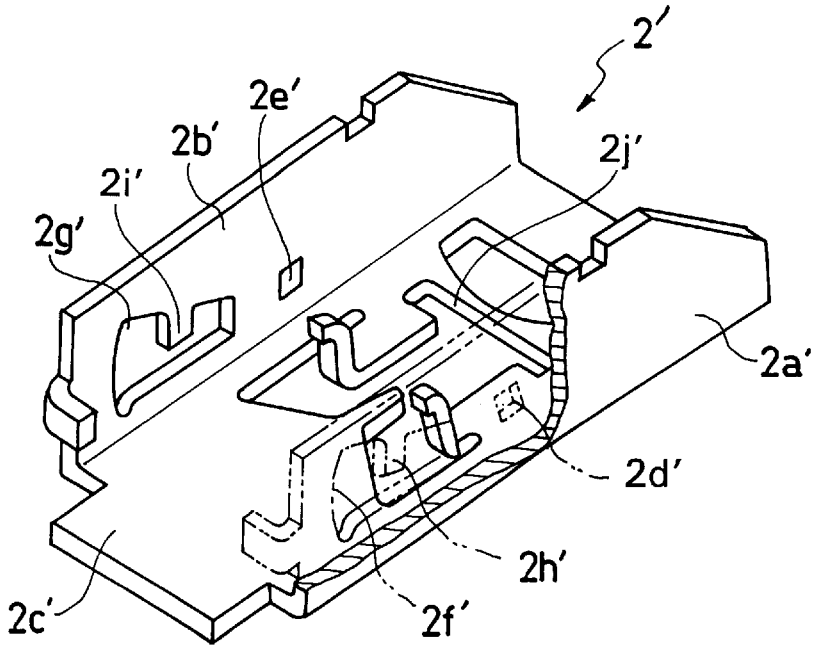
Fig. 23 Prior Art
FIG. 23 is a perspective view showing a base employed in the buckle shown in FIG. 21.
Figure 24:
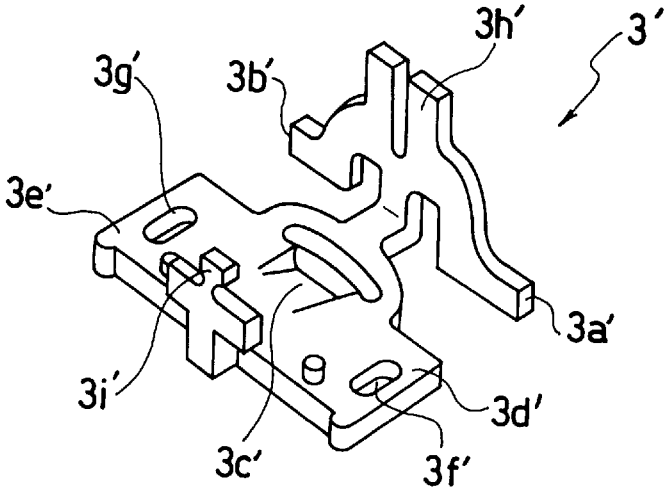
Fig. 24 Prior Art
FIG. 24 is a perspective view showing a latch member employed in tickle shown in FIG. 21.
Figure 25:
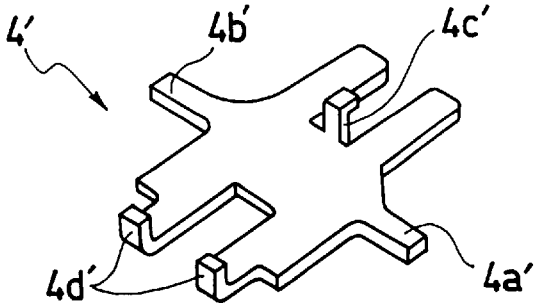
Fig. 25 Prior Art
FIG. 25 is a perspective view showing a lock member employed in the buckle shown in FIG. 21.

FIG. 1 is a view, similar to FIG. 21, showing a buckle of a first embodiment of the present invention in its non-engaged state with a tongue and FIG. 2 is a view, similar to FIG. 22, showing the buckle of the first embodiment of the present invention in its engaged state with the tongue. It should be noted that "right" and "left" in the following description represent the right and the left in the attached drawings.

As shown in FIG. 1 and FIG. 2, the buckle 1 of the first embodiment has basically the same structure as the aforementioned conventional buckle and comprises a base 2 which is a U-like frame having side walls 2*a*, 2*b*and a bottom 2*c*, a latch member 3 pivotally supported by the side walls 2*a*, 2*b* of the base 2, a lock slider 4 disposed to the side walls 2*a*, 2*b* of the base 2 in such a manner that the lock slider 4 can move linearly in the longitudinal direction of the buckle 1, an operational button 5 disposed to the side walls 2*a*, 2*b* in such a manner that the operational button 5 can move linearly in the longitudinal direction, an ejector 6 slidably disposed on the bottom 2*c* of the base 2, a slider spring 7 always biasing the lock slider 4, a button spring 8 always biasing the operational button 5, and an ejector spring 9 always biasing the ejector 6.

The side walls 2*a*, 2*b* of the base 2 have shaft holes 2*d*, 2*e* (in the drawing, since only one side wall 2*a* is illustrated, the numeral 2*e* of the shaft hole formed in the other side wall 2*b* is shown in parenthesis. Hereinafter, the same is true for other numerals.) and fan-shaped openings 2*f*, 2*g* formed therein, respectively. The shaft hole 2*d* and the fan-shaped opening 2*f* formed in one side wall 2*a*, and, the shaft hole 2*e* and the fan-shaped opening 2*g* formed in the other side wall 2*b* are positioned symmetrically about the longitudinal axis. The bottom 2*c* of the base 2 is provided with an elongated opening 2*h* formed in the center thereof.

Secured to an end portion of the base 2 opposite to the end through which the tongue 10 is inserted is a spring holder 11 supporting the respective ends of the springs 7, 8, 9. In this case, a first spring guide 11*a* for guiding the button spring 8, a second spring guide 11*b* for guiding the slider spring 7, and a third spring guide 11*c* for guiding the ejector spring 9 are disposed in an upper position, an almost middle position, a lower position of the elongated opening 2*h*, respectively.

Figure 3A:
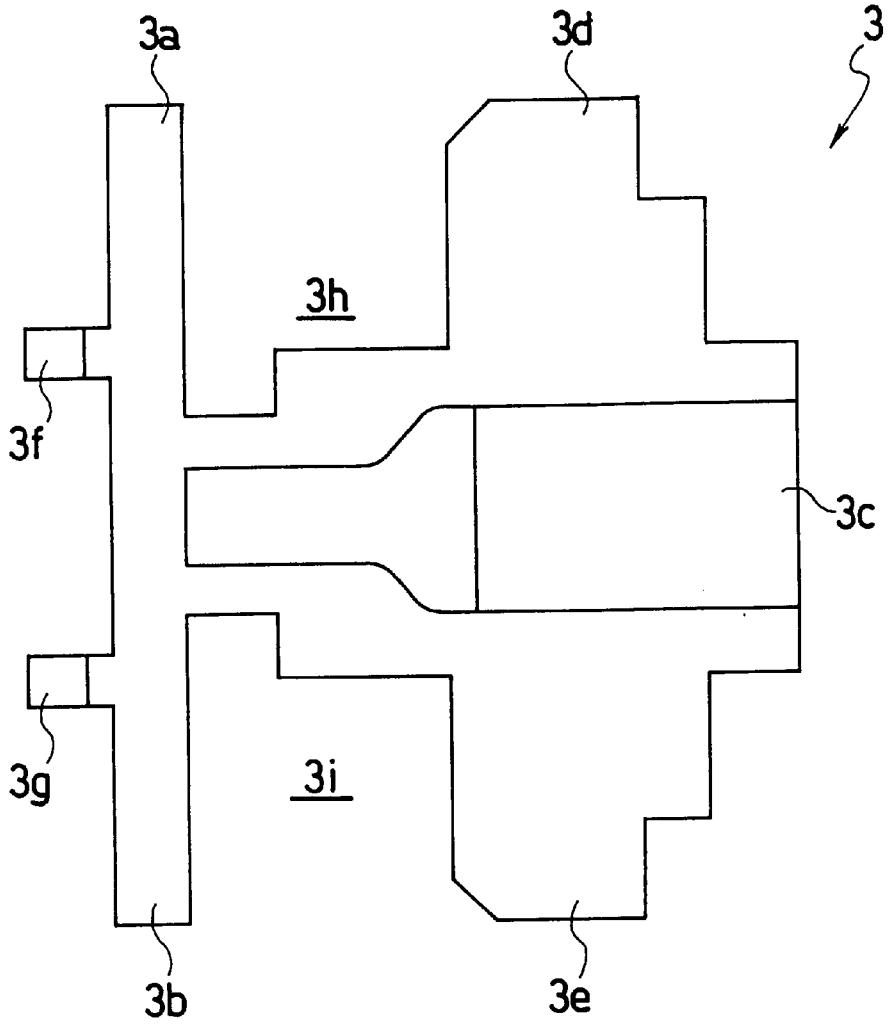
FIG. 3(*a*) is a plan view showing a latch member employed in the buckle of the first embodiment and FIG. 3(*b*) is a front view thereof.
Figure 3B:
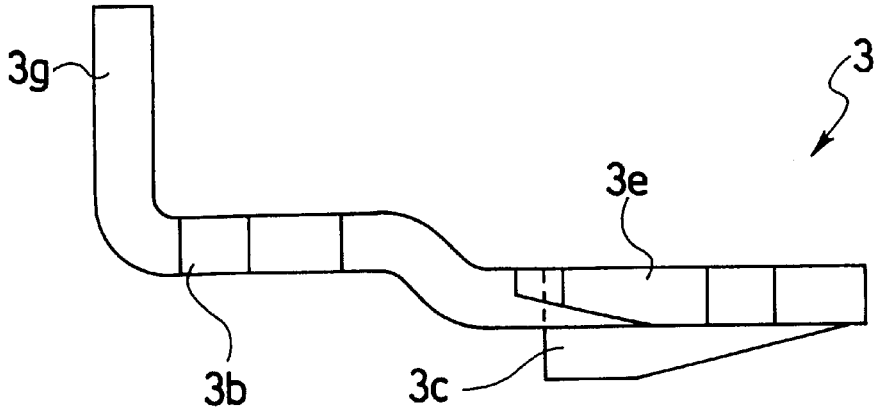

As shown in FIGS. 3(*a*) and 3(*b*), the latch member 3 is formed symmetrically about the longitudinal axis and comprises shafts 3*a*, 3*b* inserted in and supported by the shaft holes 2*d*, 2*e* of the side walls 2*a*, 2*b*, a joggle portion 3*c* which can be latched to a latch hole 10*a* of the tongue 10, shoulder portions 3*d*, 3*e* movable within the fan-shaped openings 2*f*, 2*g* and capable of being supported by the lock slider 6, and pressed portions 3*f*, 3*g* capable of coming in contact with the operational button 5.

That is, the latch member 3 can pivot about the shafts 3*a*, 3*b* between an upper or non-engaged position shown in FIG. 1 where the joggle portion 3*c* is not latched to the latch hole 10*a* of the tongue 10 and a lower or engaged portion shown in FIG. 2 where the joggle portion 3*c* is latched to the latch hole 10*a*.

The latch member 3 is provided with concave portions 3*h*, 3*i* formed between the shafts 3*a*, 3*b* and the shoulder portions 3*d*, 3*e*, respectively.

Figure 4A:
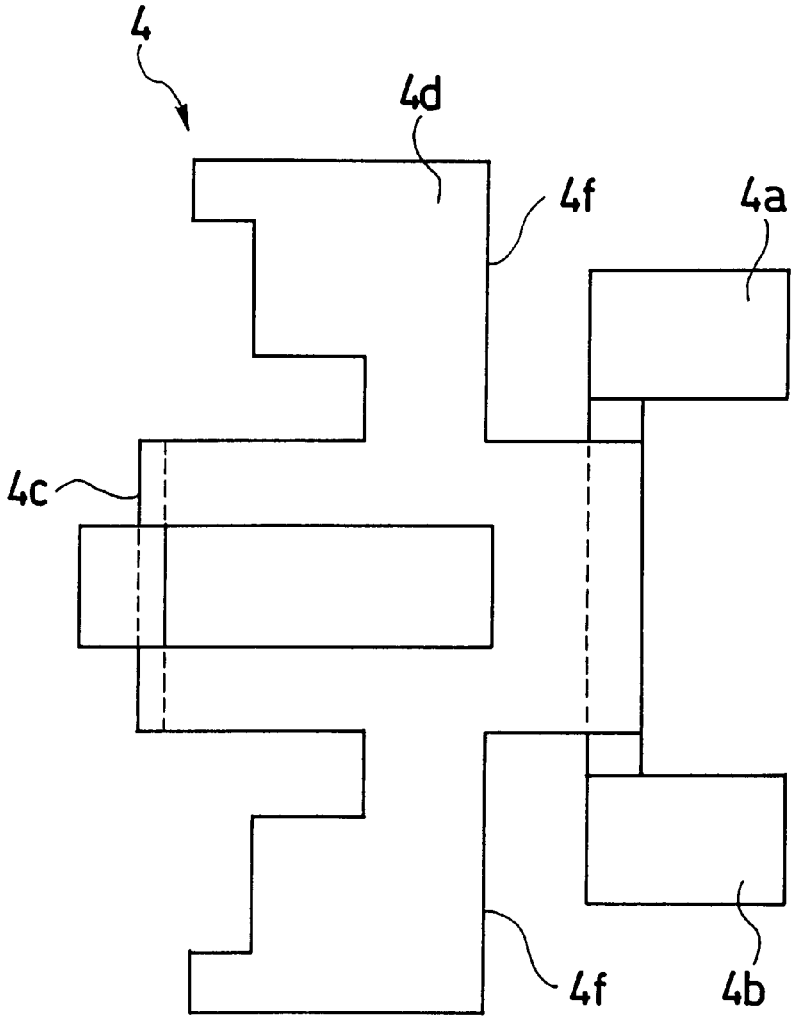
FIG. 4(*a*) is a plan view showing a lock slider employed in the buckle of the first embodiment, FIG. 4(*b*) is a front view thereof and FIG. 4(*c*) is a different structure of the lock slider.
Figure 4B:
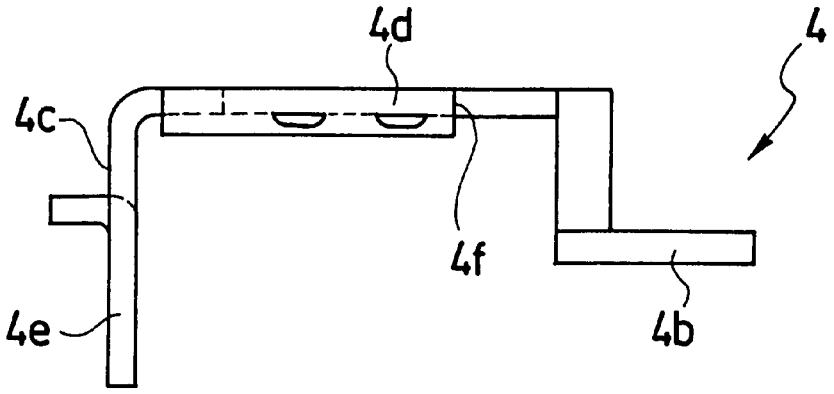
Figure 4C:
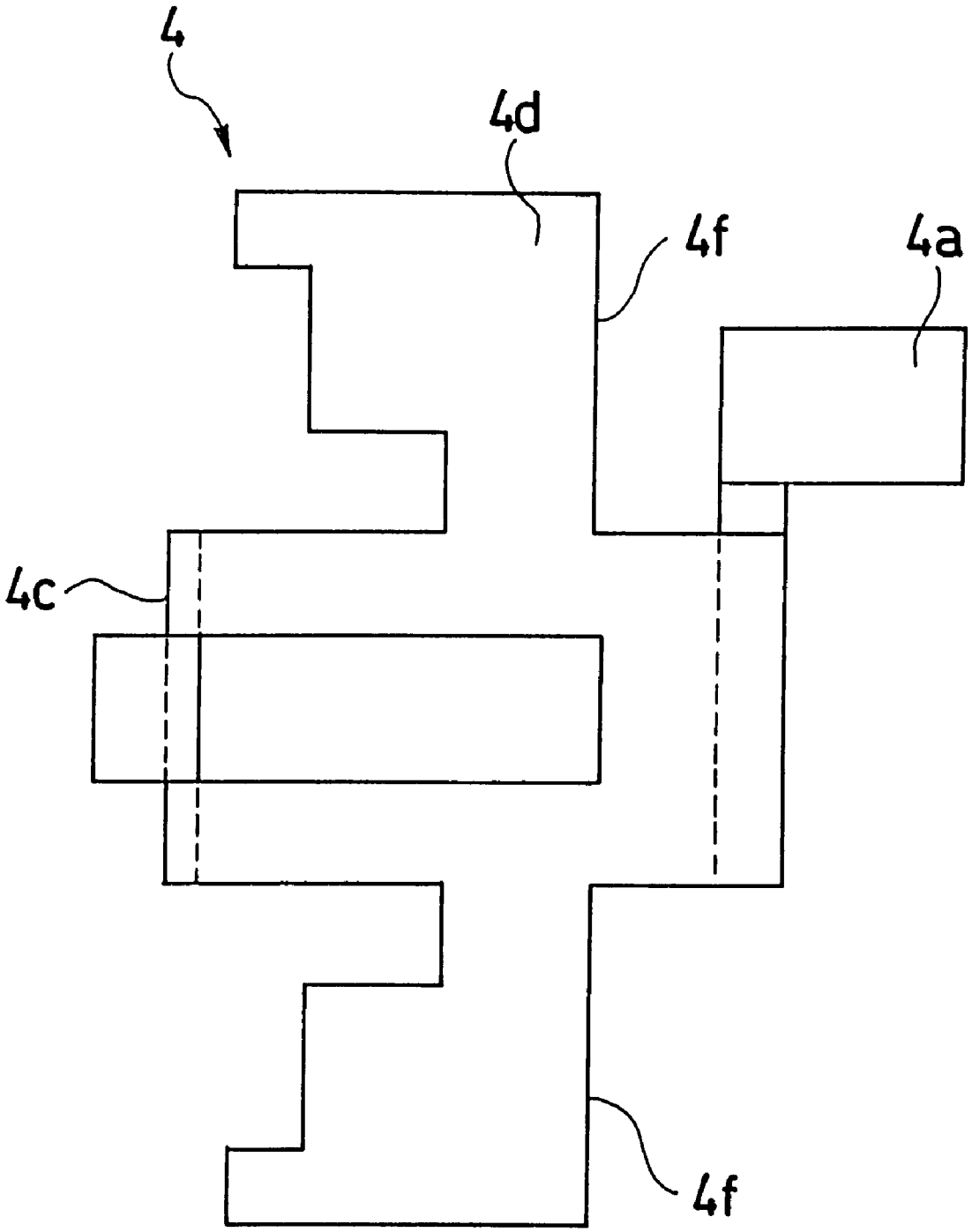

As shown in FIGS. 4(*a*) and 4(*b*), the lock slider 4 is formed symmetrically about the longitudinal axis and comprises restraint portions 4*a*, 4*b* for restraining the shoulder portions 3*d*, 3*e* of the latch member 3 when the latch member 3 is in the engaged position, a spring supporting portion 4*c* which is located at a position confronting the second spring guide 11*b* of the spring holder 11 to support the other end of the slider spring 7, a main body 4*d* which connects the restraint portions 4*a*, 4*b* and the spring supporting portion 4*c* and is supported slidably along longitudinal grooves 2*i* (shown in FIG. 1 and FIG. 2), and an ejector-contact portion 4*e* which is able to be in contact with and is pressed by the ejector 6.

That is, the lock slider 4 is movable only in the longitudinal direction of the buckle 1 and is always biased by the spring force of the slider spring 7 in such a direction (rightward in FIG. 1) that the restraint portions 4*a*, 4*b* become closer to the shoulder portions 3*d*, 3*e* of the latch member 3. The lock slider 4 may have one restraint portion 4*a*, as shown in FIG. 4(*c*).

The operational button 5 comprises an operational portion 5*a* which the seat belt user directly touches, a spring guide 5*b* which is disposed to confront the first spring guide 11*a* of the spring holder 11, a spring supporting portion 5*c* which supports the other end of the button spring 8, latch member press portions 5*d*, 5*e* which press the pressed portions 3*f*, 3*g*of the latch member 3, and lock slider press portions 5*f*, 5*g* which is able to be in contact with the pressed portions 4*f*, 4*f* of the main body 4*d* of the lock slider 4 and press and move the lock slider 4 against the spring force of the slider spring 7.

That is, the operational button 5 is always biased in a direction toward the inoperative position shown in FIG. 1 by the spring force of the button spring 8.

Figure 5A:
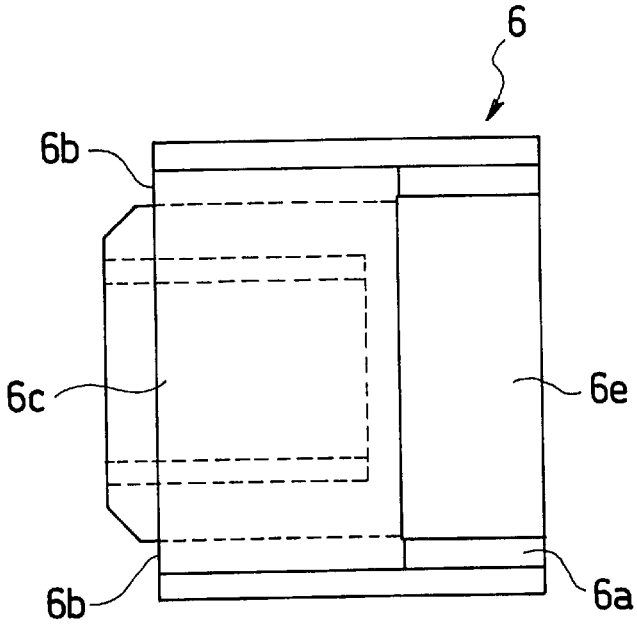
FIG. 5(*a*) is a plan view showing an ejector employed in the buckle of the first embodiment, FIG. 5(*b*) is a front view thereof, and FIG. 5(*c*) is a left-side view thereof.
Figure 5B:
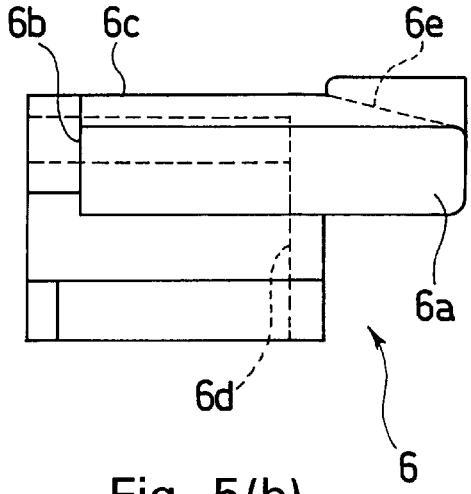
Figure 5C:
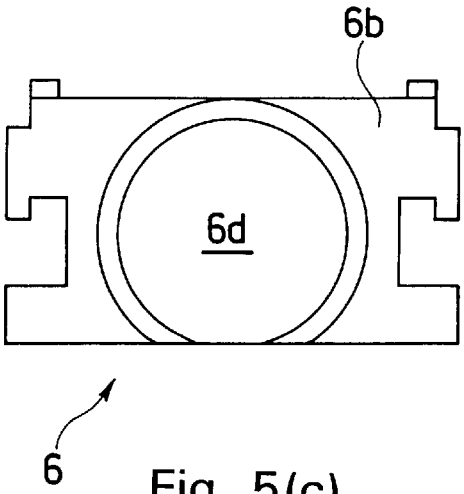
Figure 6A:
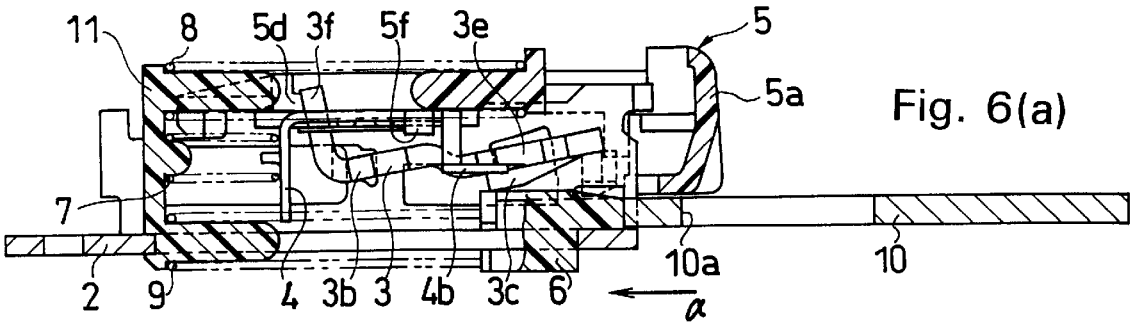
FIG. 6(*a*) through 6(*e*) are views for explaining the operation of the buckle of the first embodiment, from its non-engaged state with the tongue to its engaged state with the tongue.
Figure 6B:
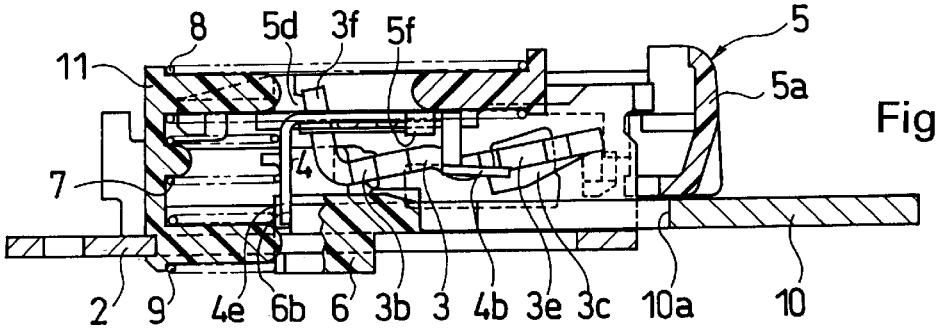
Figure 6C:
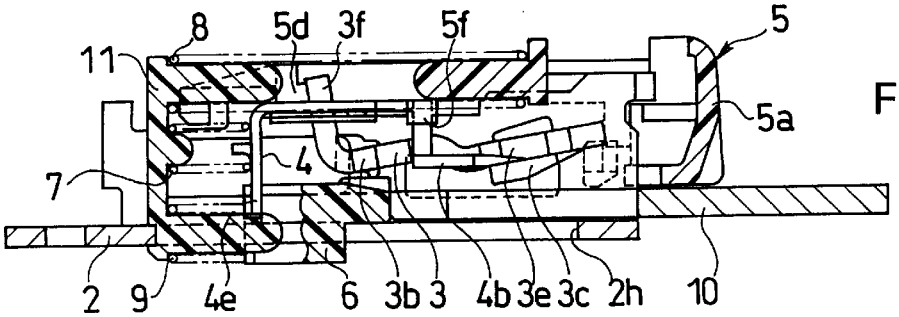
Figure 6D:
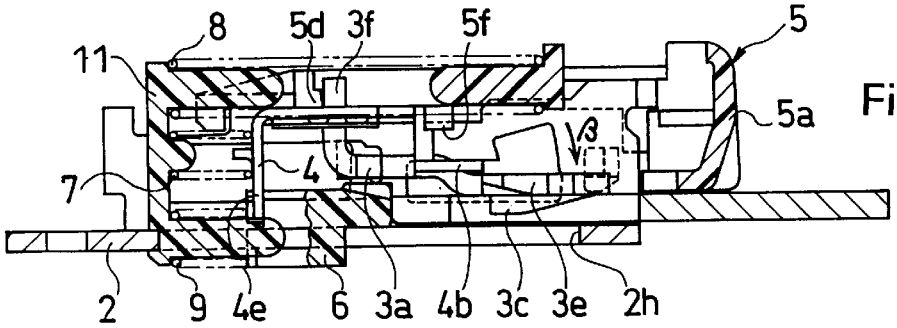
Figure 6E:
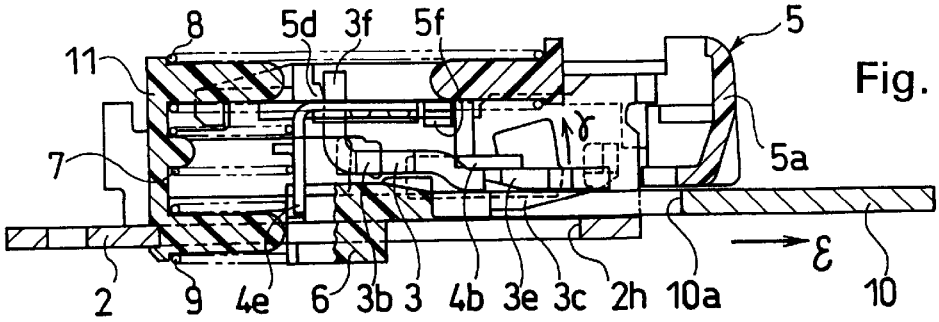
Figure 7A:
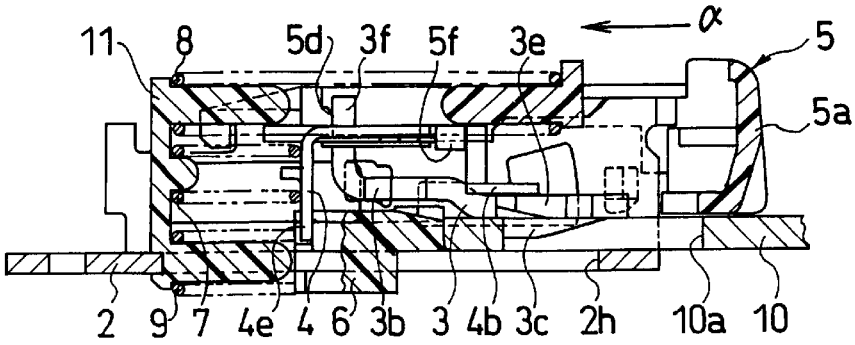
FIGS. 7(*a*) through 7(*e*) are views for explaining the operation of the buckle of the first embodiment, from its engaged state with the tongue to its non-engaged state with the tongue.
Figure 7B:
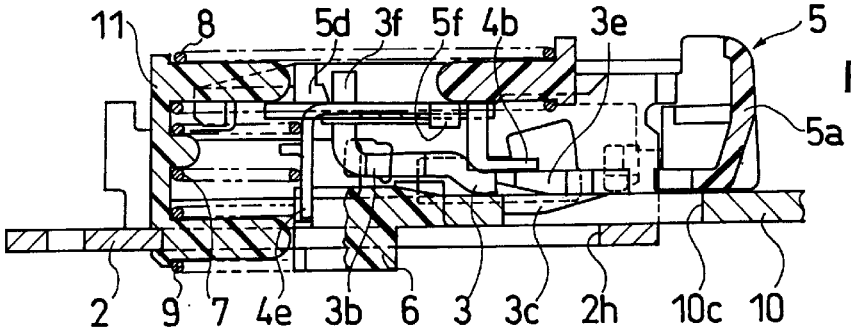
Figure 7C:
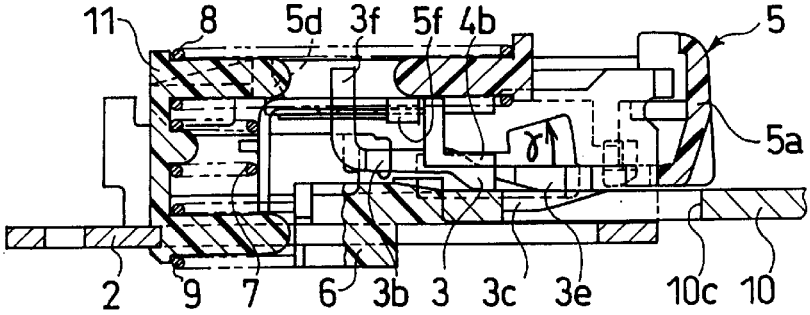
Figure 7D:
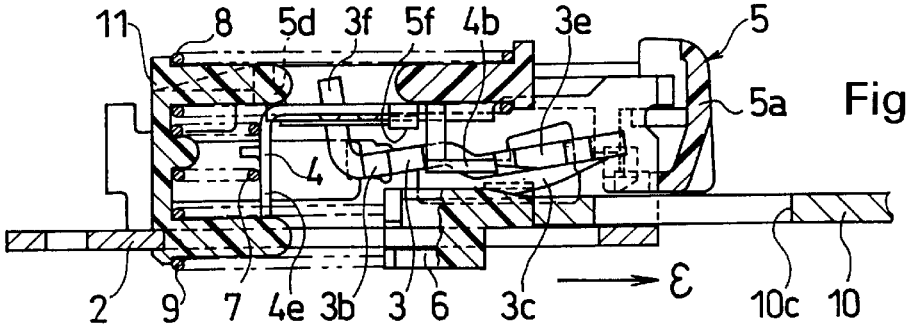
Figure 7E:
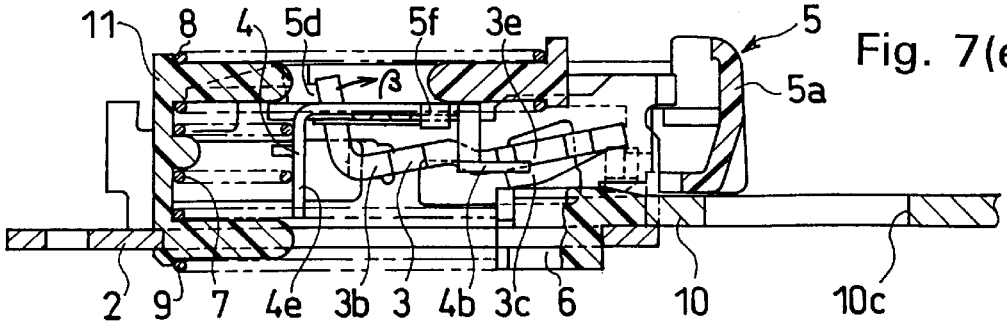

As shown in FIGS. 5(*a*), 5(*b*), and 5(*c*), the ejector 6 comprises a tongue press portion 6*a* which is disposed slidably in the longitudinal direction within the elongated opening 2*h* formed in the bottom 2*c* of the base 2 (shown in FIG. 1 and FIG. 2) to press the end of the tongue 10, lock slider press portions 6*b*, 6*b* which press the ejector-contact portion 4*e* of the lock slider 4, a holding portion 6*c* which holds the latch member 3 in the non-engaged position by the contact with the joggle portion 3*c* when the latch member 3 is in the non-engaged position, a spring supporting portion 6*d* which is composed of a hole in which the other end of the ejector spring 9 is accommodated and thus supported, and an inclined guide surface 6*e* which is able to be in contact with the lower surface of the joggle portion 3*c* to guide the joggle portion 3*c* to move upwardly according to the rightward movement of the ejector 6.

That is, the ejector 6 is always biased by the spring force of the ejector spring 9 in a direction of ejecting the tongue 10 from the buckle 1. When the tongue 10 is not inserted, the ejector 6 is in contact with the end of the elongated hole 2*h* from which the tongue 10 is inserted.

Hereinafter, the operation of the buckle 1 of the first embodiment as structured above will be described.

In the non-engaged state of the buckle 1 shown in FIG. 6(*a*) (the same drawing as FIG. 1), the restraint portions 4*a*, 4*b* of the lock slider 4 are positioned beneath the shoulder portions 3*a*, 3*b* of the latch member 3 and the lower surface of the joggle portion 3*c* is held by the holding portion 6*c* of the ejector 6. Therefore, the joggle portion 3*c* of the latch member 3 is prevented from entering into the insert path of the tongue 10, thereby ensuring the passage of the tongue.

In this state, as the tongue 10 is inserted into the buckle along the leftward direction α, the end of the tongue 10 comes in contact with the tongue press portion 6*a* of the ejector 6. As the tongue 10 is further inserted into the buckle 1, the ejector 6 is pressed by the tongue 10 so as to move also in the leftward direction α. At this point, since the holding portion 6*c* is displaced from the lower surface of the joggle portion 3 so that the spring force of the button spring 8 is transmitted from the latch member press portions 5*d*, 5*e* to the pressed portions 3*f*, 3*g*, and the latch member 3 intends to pivot about the shafts 3*a*, 3*b* in the clockwise direction. However, because the shoulder portions 3*d*, 3*e* are supported by the restraint portions 4*a*, 4*b*, the latch member 3 is prevented from further pivoting in the clockwise direction. Therefore, the joggle portion 3*c* of the latch member 3 is prevented from entering in the passage of the tongue 10 so that the passage of the tongue is ensured and thus the tongue 10 can be smoothly inserted.

As both the ejector 6 and the tongue 10 move in the leftward direction α, as shown in FIG. 6(*b*), the slider press portions 6*b*, 6*b* come in contact with the ejector-contact portion 4*e* of the lock slider 4. At this point, the latch hole 10*a* of the tongue 10 is in such a position that the latch end thereof (left end of the latch hole 10*a*) is slightly on the left side of the latch end (left end) of the joggle portion 3*c* of the latch member 3.

As the tongue 10 is further inserted, as shown in FIG. 6(*c*), the lock slider 4 moves in the leftward direction α so that the restraint portions 4*a*, 4*b* are displaced from the shoulder portions 3*d*, 3*e*. At this point, the latch hole 10*a* is in such a position that the center thereof is right beneath the joggle portion 3*c*. As the restraint portions 4*a*, 4*b* are displaced from the shoulder portions 3*d*, 3*e*, the latch member 3 pivots about the shafts 3*a*, 3*b* in the clockwise direction β because the pressed portions 3*f*, 3*g* of the latch member 3 is pressed by the latch member press portions 5*d*, 5*e* of the operational button 5 with the spring force of the button spring 8. Therefore, as shown in FIG. 6(*d*), the joggle portion 3*c* of the latch member 3 completely enters into substantially the central portion of the latch hole 10*a*, i.e. becomes in the engaged position and the lower surfaces of the restraint portions 4*a*, 4*b* are positioned slightly upward from the upper surfaces of the shoulder portions 3*d*, 3*e*.

As the force of inserting is cancelled by releasing the tongue 10 in this state, as shown in FIG. 6(*e*), the ejector 6 and the tongue 10 move in the rightward direction ϵ by the spring force of the ejector spring 9 so that the latch end of the latch hole 10*a* of the tongue 10 comes in contact with the latch end of the joggle portion 3*c* of the latch member 3. In this way, the tongue 10 is latched to the latch member 3. At the same time, the lock slider 4 moves rightward because of the spring force of the slider spring 7 so that the restraint portions 4*a*, 4*b* are positioned right above the shoulder portions 3*d*, 3*e* with a slight distance between the restraint portions 4*a*, 4*b* and the shoulder portions 3*d*, 3*e*. As a result of this, even when an abnormal impact is applied e.g. in the event of a vehicle collision, the latch member 3 is restrained from pivoting in the counter-clockwise direction γ because the restraint portions 4*a*, 4*b* are positioned right above the shoulder portions 3*d*, 3*e*, so the latch member 3 is held in the engaged position. As a result, the buckle 1 and the tongue 10 are securely prevented from releasing from each other. In the engaged state where the buckle 1 and the tongue 10 are engaged, the slider press portions 5*f*, 5*g* are spaced apart from the pressed portions 4*f*, 4*f* of the main body 4*d* of the lock slider 4 by release play δ as shown in FIG. 2.

For releasing the tongue 10 from the buckle 1 from the engaged state where the buckle 1 and the tongue 10 are engaged shown in FIG. 7(*a*) (the same drawing as FIG. 2), the operational portion 5*a* of the operational button 5 is pressed in the leftward direction a by a finger. Then, as shown in FIG. 7(*b*), the operational button 5 moves in the leftward direction α for the release play δ so that the latch member press portions 5*d*, 5*e* of the operational button 5 moves apart from the pressed portions 3*f*, 3*g* of the latch member 3 and the slider press portions 5*f*, 5*g* come in contact with the pressed portions 4*f*, 4*f* of the main body 4*d* of the lock slider 4.

As the operational button 5 is further pressed, the slider press portions 5*f*, 5*g* of the operational button 5 press the lock slider 4 to move in the leftward direction α along the longitudinal direction of the buckle 1 until a slight clearance is created between the restraint portions 4*a*, 4*b* and the shoulder portion 3*d*, 3*e* as shown in FIG. 7(*c*). As a result of this, the latch member 3 is allowed to pivot about the shafts 3*a*, 3*b* in the counter-clockwise direction γ. Since the ejector 6 is biased by the spring force of the ejector spring 9 in the direction of releasing the tongue, as shown in FIG. 7(*d*), the ejector 6 pushes out the tongue 10 in the rightward direction ϵ and, at the same time, pushes up the latch member 3 so that the latch member 3 pivots about the shafts 3*a*, 3*b* in the counter-clockwise direction γ and the joggle portion 3*c* escapes from the latch hole 10*a* of the tongue 10.

Therefore, the ejector 6 moves further in the rightward direction ϵ to push out the tongue 10 and, at the same time, the lower surface of the joggle portion 3*c* comes in contact with the inclined guide surface of the ejector 6 so that the latch member 3 pivots in the counter-clockwise direction γ according to the movement of the ejector 6 in the rightward direction ϵ. When the lower surface of the joggle portion 3*c* reaches the upper-most position of the ejector 6, the latch member 3 is stopped from pivoting in the counter-clockwise direction γ. In this state, the upper surfaces of the restraint portions 4*a*, 4*b* of the lock slider 4 are positioned slightly below the lower surfaces of the shoulder portions 3*d*, 3*e* of the latch member 3.

As the operational button 5 is released from the finger, as shown in FIG. 7(*e*), the operational button 5 moves to the inoperative position because of the spring force of the button spring 8 and the latch member press portions 5*d*, 5*e* come in contact with the pressed portions 3*f*, 3*g* of the latch member 3, thereby biasing the latch member 3 in the clockwise direction β as mentioned above. At the same time, the lock slider 4 moves in the rightward direction ϵ because of the spring force of the slider spring 7 so that the restraint portions 4*a*, 4*b* enter into positions right beneath the shoulder portions 3*d*, 3*e*, the ejector 6 returns in the non-engaged position, and the joggle portion 3*c* is held by the holding portion 6*c* of the ejector 6.

In this way, the buckle 1 and the tongue 10 are completely released from each other and the buckle 1 becomes in the inoperative state shown in FIG.1.

As mentioned above, in the buckle 1 of the first embodiment, the lock slider 4, which corresponds to the lock member of the conventional buckle, moves linearly only in the longitudinal direction of the buckle 1 during the control for latching the latch member 3. That is, the movement of the lock slider 4 is significantly simple and thus smooth as compared to the movement of the conventional lock member which both pivots and moves linearly. This improves the controllability of the latch member 3.

Figure 8A:
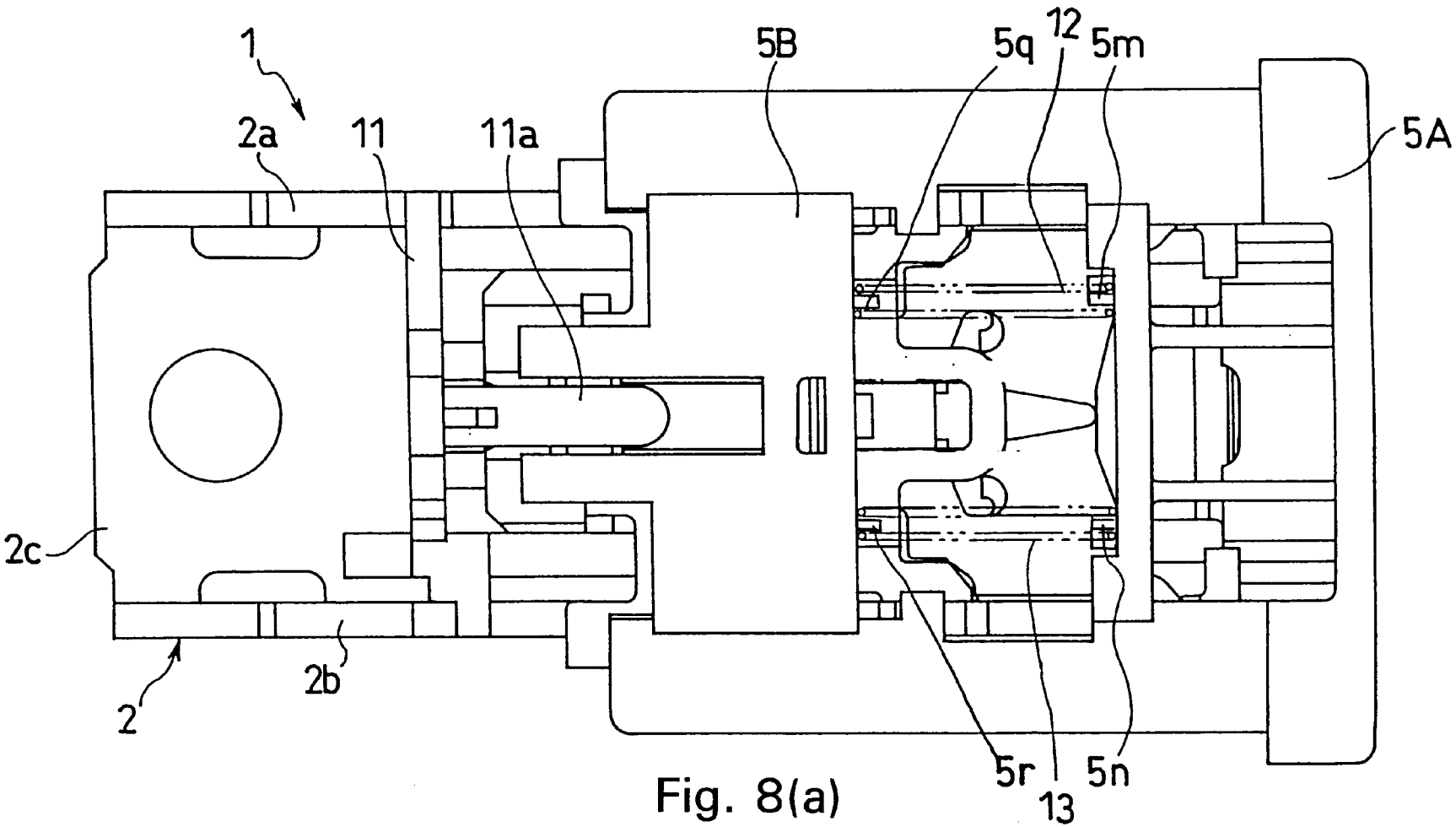
FIG. 8(*a*) is a plan view showing a buckle of a second embodiment of the present invention and FIG. 8(*b*) is a partial sectional view in which the buckle is shown in its non-engaged state with a tongue, FIG. 9(*a*) is a plan view showing a first operational piece employed in the buckle of the second embodiment, FIG. 9(*b*) is a sectional view taken along a line 9*b*—9*b* of FIG. 9(*a*), and FIG. 9(*c*) is a view taken from a direction 9*c* of FIG. 9(*b*)
Figure 8B:
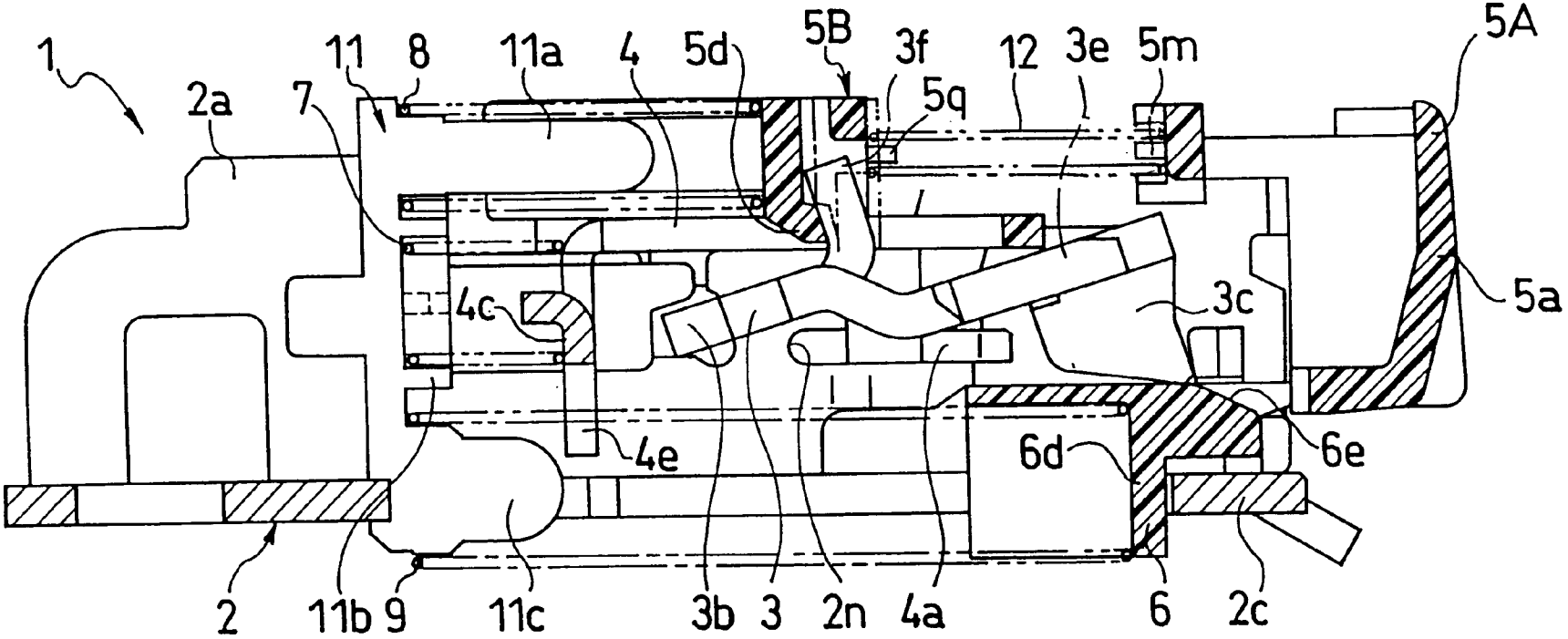

FIG. 8(*a*) is a plan view showing a buckle of a second embodiment of the present invention and FIG. 8(*b*) is a sectional view similar to FIG. 1 showing the buckle in its non-engaged state with a tongue. It should be noted that parts similar or corresponding to the parts of the first embodiment will be marked by the same reference numerals so that the detailed description about the parts will be omitted.

In the aforementioned first embodiment, the pressed portions 3*f*, 3*g* of the latch member 3 are positioned as shown by solid lines in FIG. 1 in the non-engaged state where the buckle 1 and the tongue 10 are not engaged, while the pressed portions 3*f*, 3*g* are positioned as shown by chain double-dashed lines in the engaged state where the buckle 1 and the tongue 10 are engaged, since the latch member 3 pivots about the shafts 3*a*, 3*b* to move the pressed portions 3*f*, 3*g* rightward in FIG. 1. Accordingly, the latch member press portions 5*d*, 5*e* of the operational button 5 which are always in contact with the latch member 3 also move from the position shown by solid lines to the position shown by chain double-dashed lines. Since the latch member press portions 5*d*, 5*e* are formed integrally with the operational button 5, the operational button 5 moves rightward so that the operational portion 5*a* moves from the position shown in solid lines in the non-engaged state to the rightward position shown in chain double-dashed lines in the engaged state.

In the buckle of the first embodiment as mentioned above, the position of the operational portion 5*a* should be different between the non-engaged state and the engaged state with the tongue 10. This sometimes gives a sense of incongruity to the seat belt user. Though this sense of incongruity does not cause any trouble on the wear and the function of the seat belt, it is desirable not to change the position of the operational portion 5*a* to remove this sense of incongruity. It should be noted that the change in the position of the operational portion 5*a* is illustrated exaggeratedly in FIG. 1 and is quite little actually.

Figure 9A:
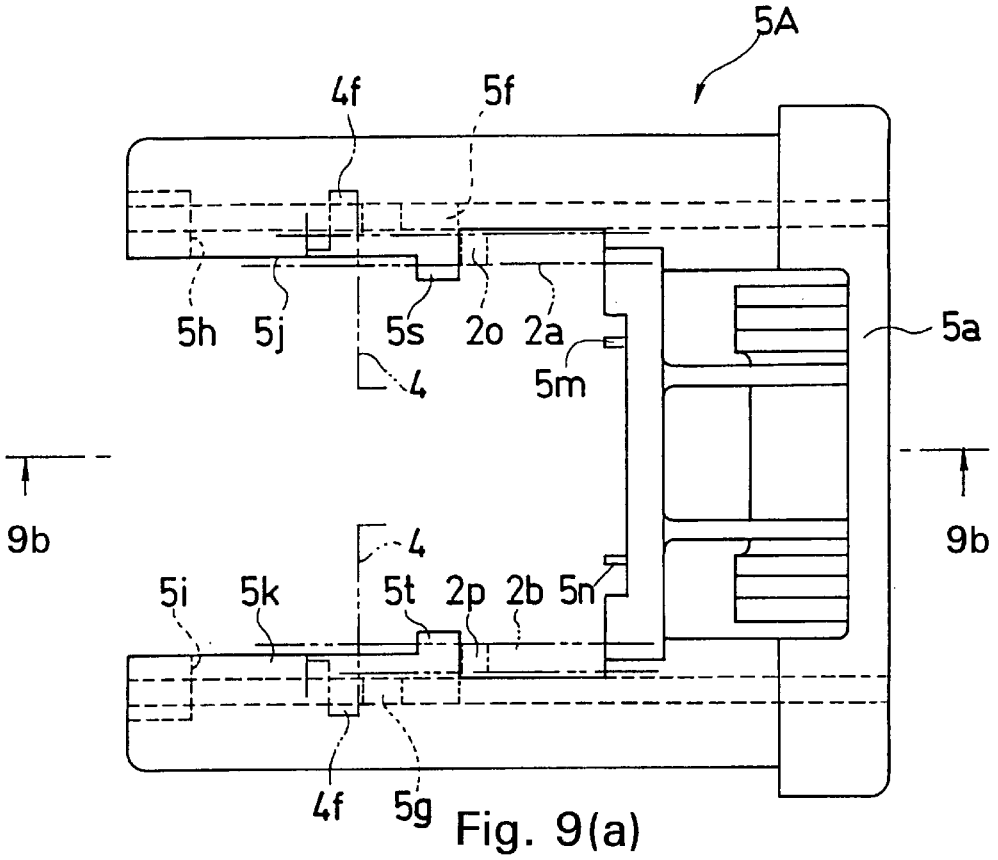
Figure 9B:
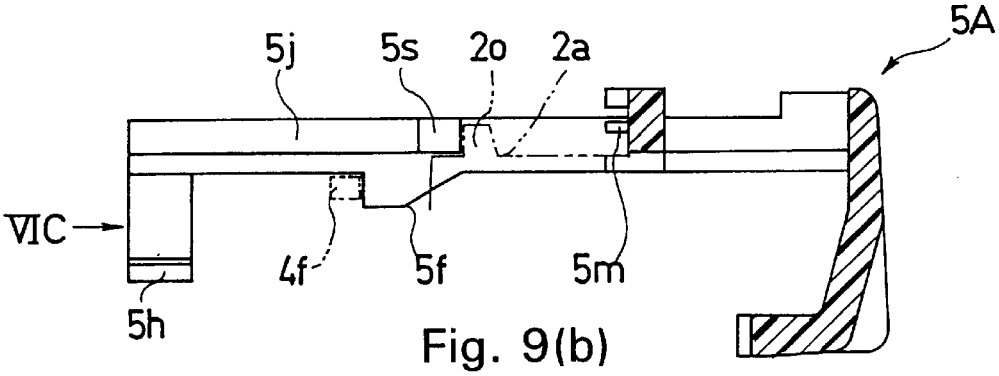
Figure 9C:
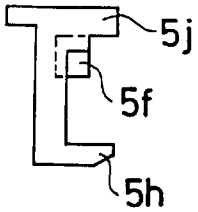

Therefore, in the second embodiment, the buckle 1 is designed in such a manner that the position of the operational portion 5*a* is not changed between the non-engaged state and the engaged state with the tongue 10. That is, as shown in FIG. 8, in the buckle 1 of the second embodiment, the operational button 5 comprises two members: a first operational piece 5A and a second operational piece 5B. As shown in FIGS. 9(*a*) and 9(*b*), the first operational piece 5A is formed symmetrically about the longitudinal axis and is disposed on the side walls 2*a*, 2*b* of the base 2 in such a manner that the first operational piece 5A is slidable along the side walls 2*a*, 2*b* in the longitudinal direction of the buckle. The first operational piece 5A is provided with an operational portion 5*a* and slider press portions 5*f*, 5*g*, just like the first embodiment. Guides 5*h*, 5*i* (the guide 5*i* is similar to 5*h* illustrated in FIG. 9(*c*)) are disposed on the first operational piece 5A to guide the first operational piece 5A along the side walls 2*a*, 2*b* of the base 2.

The first operational piece 5A is also provided with guide rails 5*j*, 5*k* for guiding the second operational piece 5B and spring guide supporting portions 5*m*, 5*n* capable of supporting springs which will be described later. The first operational piece 5A is further provided with stoppers 5*s*, 5*t*, and as shown in FIGS. 9(*a*), 9(*b*), the stoppers 5*s*, 5*t* come in contact with stopper projections 2*o*, 2*p* (shown by chain double-dashed lines in FIGS. 9(*a*), 9(*b*)) of the side walls 2*a*, 2*b* of the base 2, which will be described later, thereby preventing the first operational piece 5A from moving rightward from the inoperative position shown in FIG. 8(*b*).

Figure 10A:
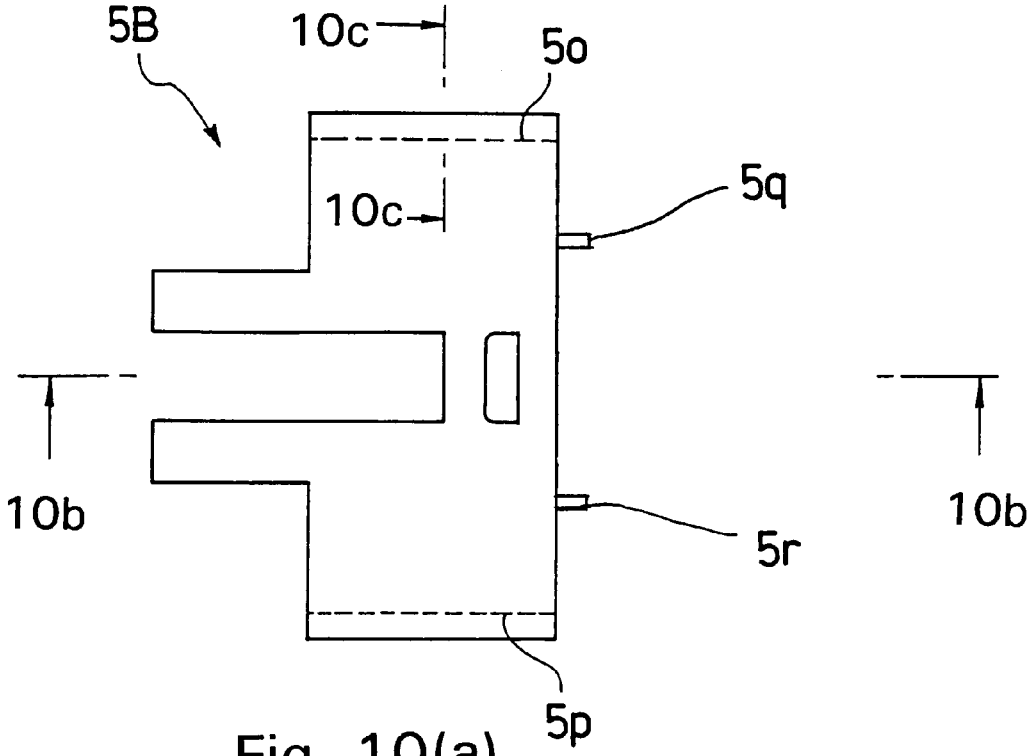
FIG. 10(*a*) is a plan view showing a second operational piece employed in the buckle of the second embodiment, FIG. 10(*b*) is a sectional view taken along a line 10*b*—10*b* of FIG. 10(*a*), and FIG. 10(*c*) is a sectional view taken along a line 10*c*—10*c* of FIG. 10(*a*)
Figure 10B:
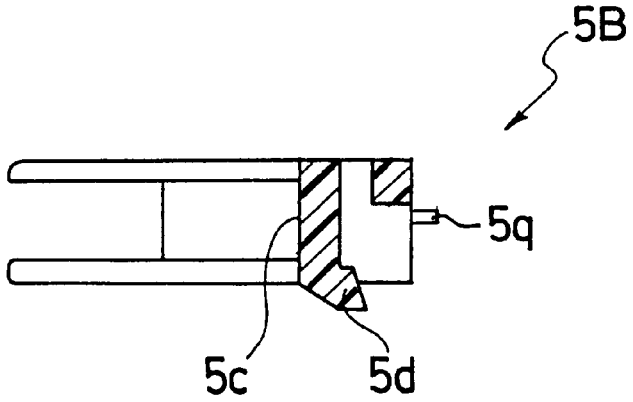
Figure 10C:
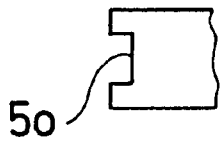

As shown in FIGS. 10(*a*) and 10(*b*), the second operational piece 5B is formed symmetrically about the longitudinal axis and is disposed in such a manner that the second operational piece 5B is able to slide along the guide rails 5*j*, 5*k* relative to the first operational piece 5A. The second operational piece 5B comprises, just like the first embodiment, a spring supporting member 5*c* which supports the other end of the button spring 8 and a latch member press portion 5*d* which presses a pressed portion 3*f* of the latch member 3. The second operational piece 5B is also provided with guide grooves 5*o*, 5*p* which fit to the guide rails 5*j*, 5*k* of the first operational piece 5A. Therefore, the second operational piece 5B is always biased rightward in FIG. 8(*b*) by the spring force of the button spring 8.

The second operational piece 5B has spring guide supporting portions 5*q*, 5*r* formed integrally therewith, which are positioned to confront the spring guide supporting portions 5*m*, 5*n* of the first operational piece 5A. Between the first and second operational pieces 5A, 5B, two springs 12, 13 are compressed and supported between the spring guide supporting portions 5*m*, 5*n* and 5*q*, 5*r*. When the second operational piece 5B moves rightward relative to the first operational piece 5A in FIGS. 8(*a*), 8(*b*), the springs 12, 13 are elastically deformed whereby the sliding movement of the second operational piece 5B is absorbed so as not to change the location of the first operational piece 5A. That is, even when the second operational piece 5B moves relative to the first operational piece 5A, the first operational piece 5A does not move.

Figure 11A:
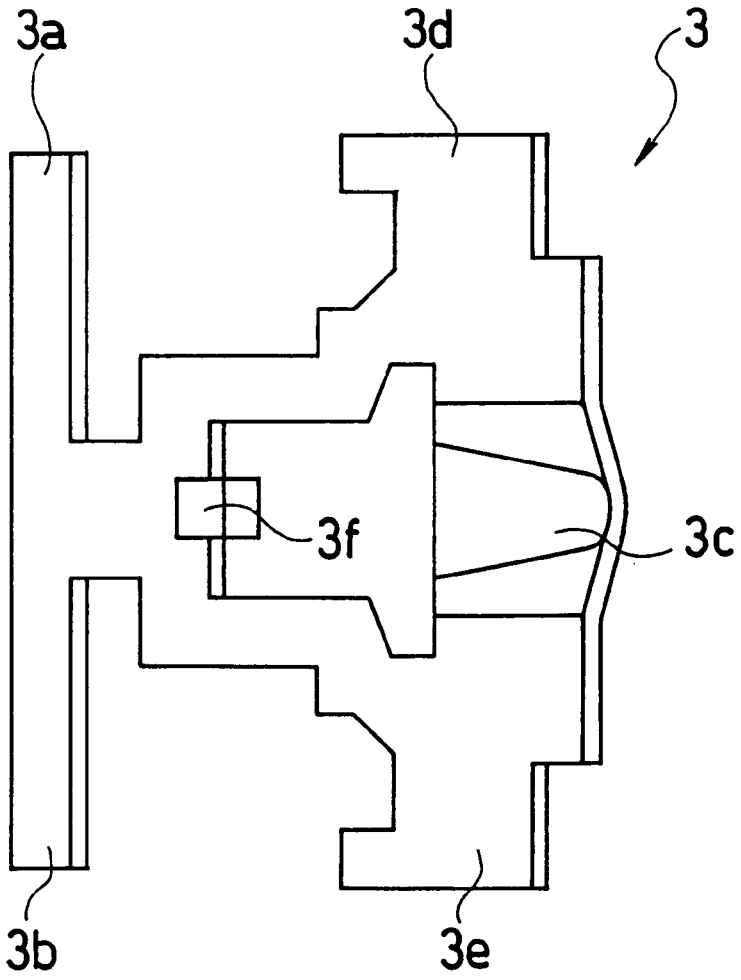
FIG. 11(*a*) is a plan view showing a latch member employed in the buckle of the second embodiment and FIG. 11(*b*) is a front view thereof.
Figure 11B:
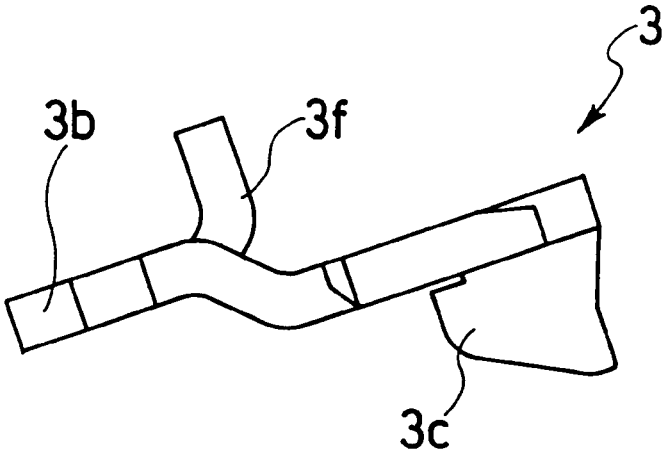
Figure 12A:
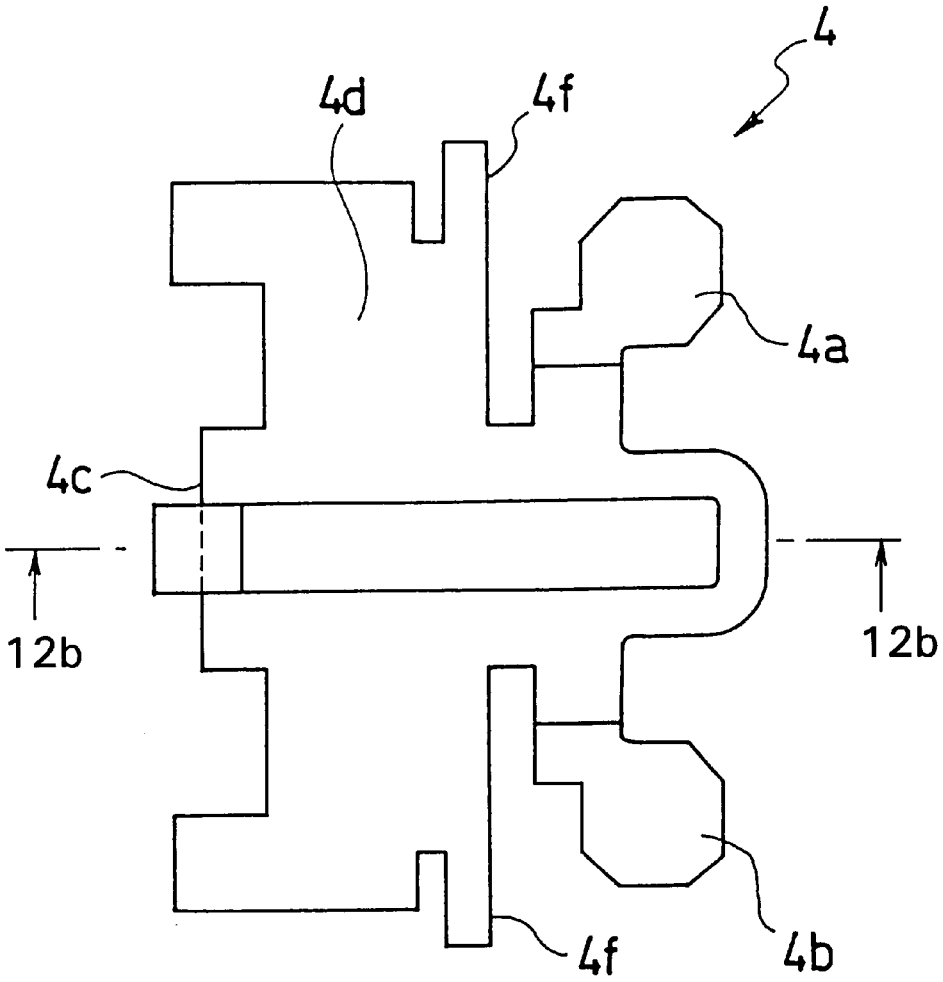
FIG. 12(*a*) is a plan view showing a lock slider employed in the buckle of the second embodiment and FIG. 12(*b*) is a sectional view taken along a line 12*b*—12*b;*
Figure 12B:
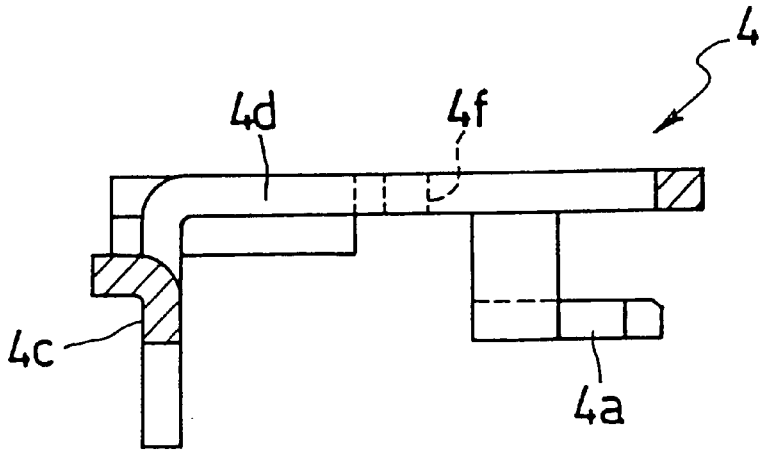

As shown in FIGS. 11(*a*) and 11(*b*), the latch member 3 has substantially the same structure as that of the latch member 3 of the first embodiment except the following points. That is, the latch member 3 has the pressed portion 3*f* disposed at the center thereof which is able to come in contact with the latch member press portion 5*d* of the second operational piece 5B. The pressed portion 3*f* is disposed on the side of the joggle 3*c* in respect to the shafts 3*a*, 3*b*. Since the pressed portion 3*f* is disposed on the side of the joggle 3*c* in respect to the shafts 3*a*, 3*b* as mentioned above, the force exerted on the joggle portion 3*c* becomes closer to the spring force of the button spring and the length of the latch member in the longitudinal direction is shortened. The joggle portion 3*c* has an inclined lower surface converse to that of the first embodiment, that is, the lower surface inclines downward to the right in FIG. 11(*b*). As shown in FIGS. 12(*a*) and 12(*b*), the lock slider 4 has substantially the same structure as that of the lock slider 4 of the first embodiment.

Figure 13A:
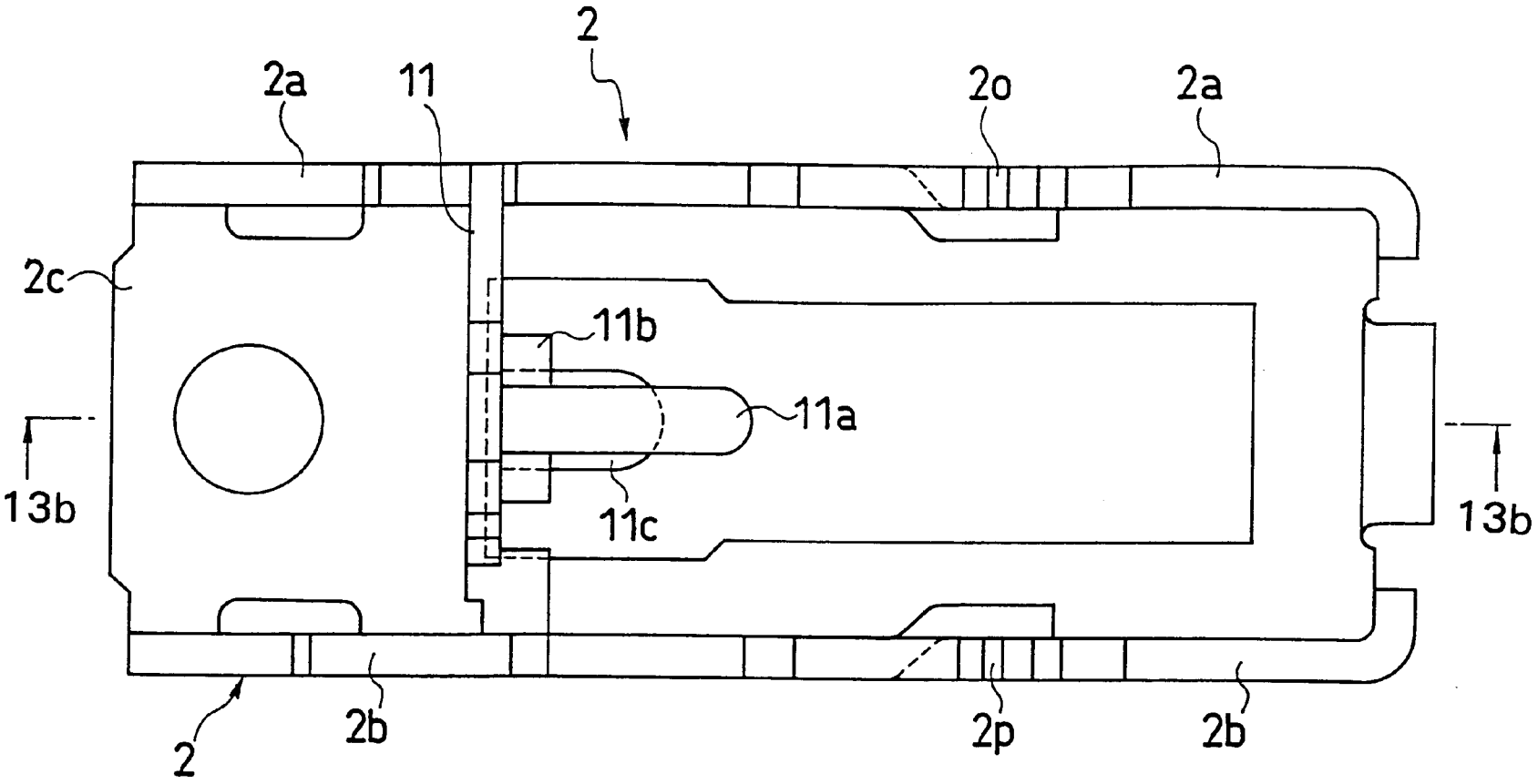
FIG. 13(*a*) is a plan view showing a base employed in the buckle of the second embodiment and FIG. 13(*b*) is a sectional view taken along a line 13*b*—13*b* of FIG. 13(*a*)
Figure 13B:
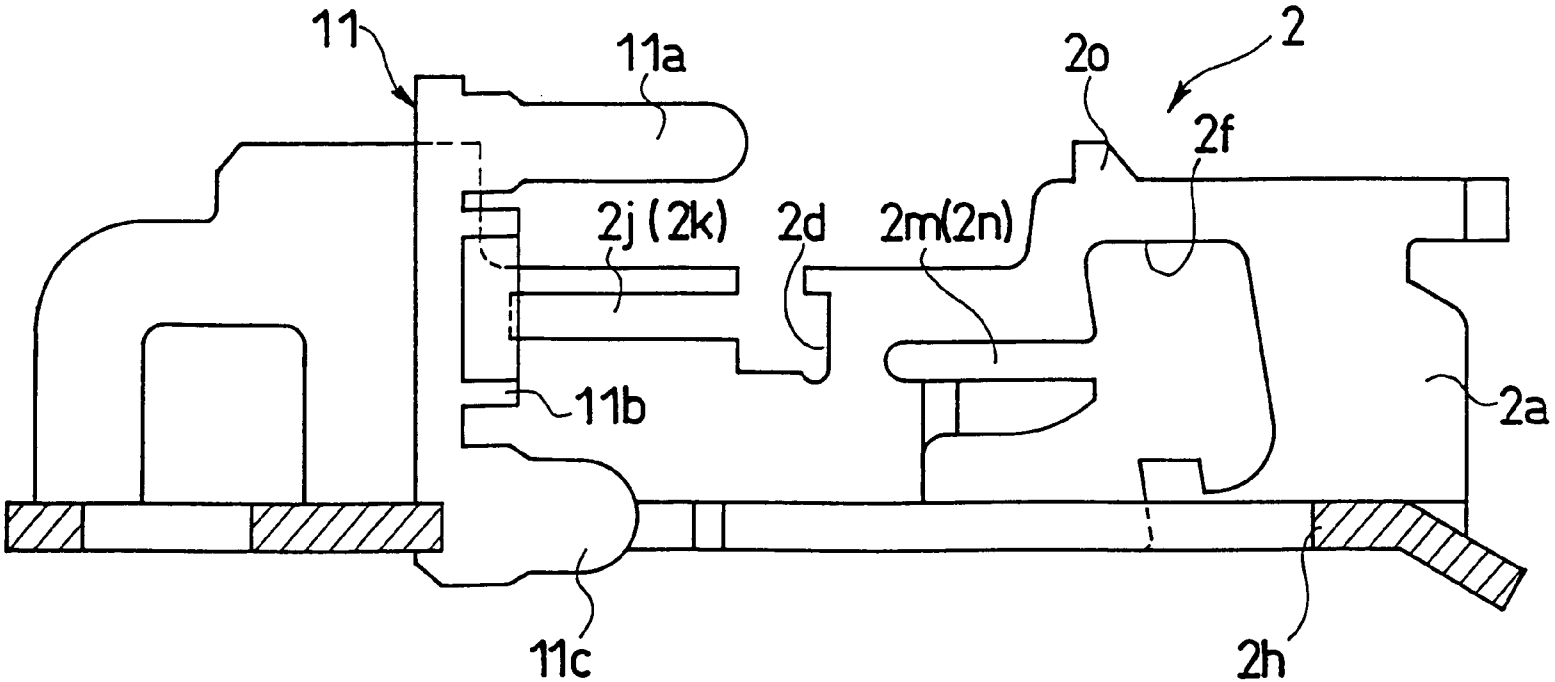

As shown in FIGS. 13(*a*) and 13(*b*), the base 2 has the side walls 2*a*, 2*b* and the bottom 2*c* and is formed symmetrically about the longitudinal axis in the same manner as the first embodiment. The side walls 2*a*, 2*b* have shaft holes 2*d*, 2*e* and fan-shaped openings 2*f*, 2*g* formed therein, respectively. The bottom 2*c* of the base 2 is provided with an elongated opening 2*h* formed in the center thereof, into which the ejector 6 is able to slide.

The side walls 2*a*, 2*b* have second operating guide holes 2*j*, 2*k* continued from the shaft holes 2*d*, 2*e* and extending in the longitudinal direction, into which the guides 5*h*, 5*i* of the second operational piece 5B are fitted so that the guides 5*h*, 5*i* are slidably guided. The side walls 2*a*, 2*b* also have restraint guide holes 2*m*, 2*n* continued from the fan-shaped openings 2*f*, 2*g* and extending in the longitudinal direction, into which the restraint portions 4*a*, 4*b* of the lock slider 4 are fitted so that the restraint portions 4*a*, 4*b* are slidably guided.

The side walls 2*a*, 2*b* are provided with stopper projections 2*o*, 2*p*, respectively. The stoppers 5*s*, 5*t* of the first operational piece 5A come in contact with the stopper projections 2*o*, 2*p*, thereby restricting the rightward movement of the first operational piece 5A as mentioned above.

The other structure of the buckle 1 of the second embodiment is the same as that of the first embodiment.

In the buckle 1 of the second embodiment as structured above, in the non-engaged state with the tongue 10, the restraint portions 4*a*, 4*b* of the lock slider 4 are positioned beneath the shoulder portions 3*d*, 3*e* of the latch member 3 as shown in FIG. 8(*b*), in the same manner as the first embodiment shown in FIG. 1. The latch member 3 is in the upper or non-engaged position where the joggle portion 3*c* is supported by the upper surface of the ejector 6.

Figure 14:
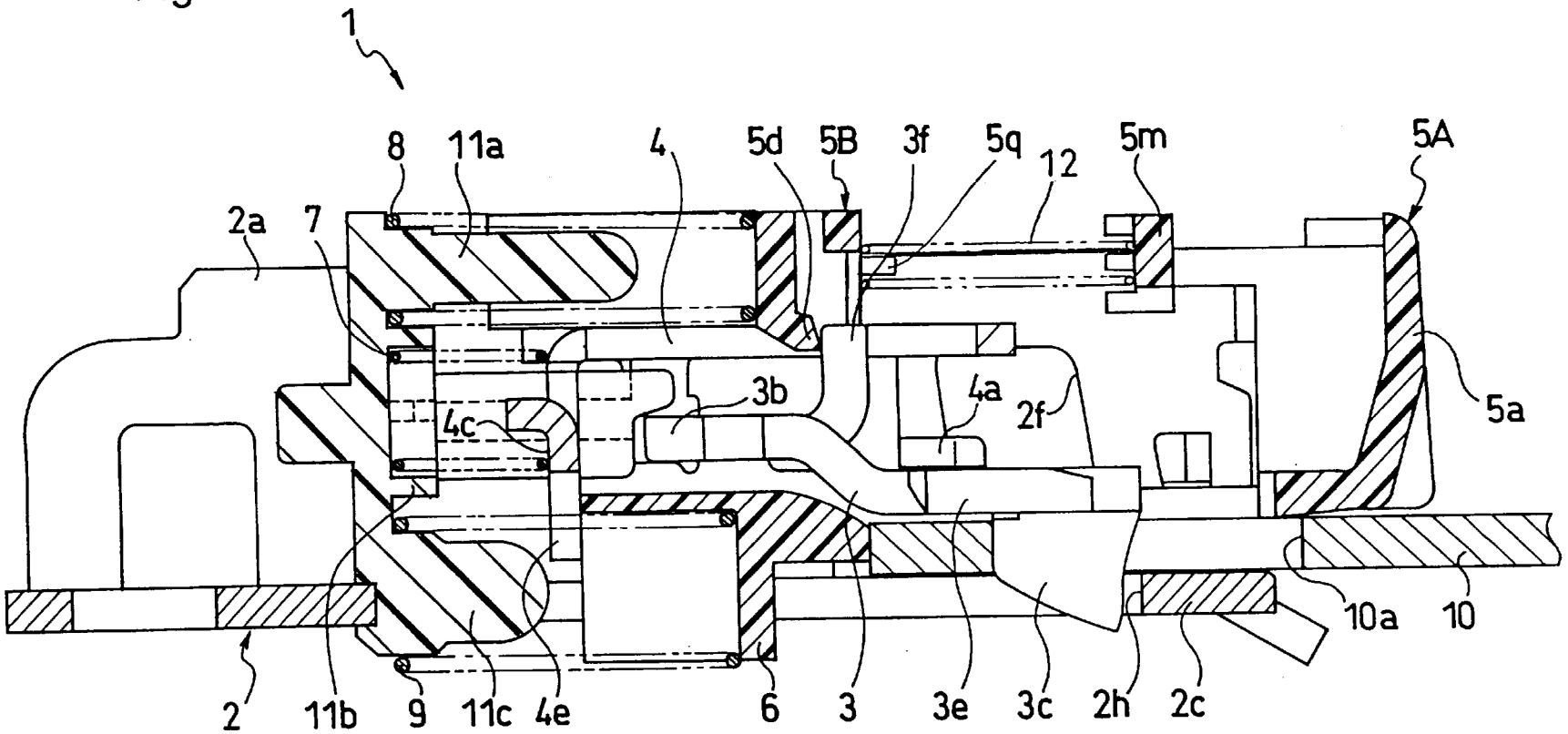
FIG. 14 is a partial sectional view showing the buckle of the second embodiment, in a state where the tongue is engaged.

In this state, the tongue 10 is inserted into the buckle 1 in the same manner as the first embodiment shown in FIGS. 6(*a*) through 6(*e*), the lock slider 4 slides in the longitudinal direction by the ejector 6 and the latch member 3 pivots about the shafts 3*a*, 3*b* to the engaged position so that the joggle 3*c* enters into the latch hole 10*a* of the tongue 10. In this way, the tongue 10 is engaged and connected to the buckle 1 as shown in FIG. 14. At this point, since the restraint portions 4*a*, 4*b* of the lock slider 4 are positioned above the shoulder portions 3*d*, 3*e* of the latch member 3, the pivotal movement of the latch member 3 in the counter-clockwise direction is prevented by the restraint portions 4*a*, 4*b*, thereby locking the latch member 3 in the engaged position.

As mentioned above, the pressed portion 3*f* of the latch member 3 are displaced from the non-engaged position to the position shown by chain double-dashed lines in FIG. 8(*b*) so that the latch member press portion 5*d* is also displaced to the position shown by chain double-dashed lines in the state where the tongue 10 and the buckle 1 are engaged, in the same manner as the aforementioned first embodiment. Since the latch member press portion 5*d* is included in the second operational piece 5B in the second embodiment, the second operational piece 5B is also displaced to the position shown by chain double-dashed lines. However, the stoppers 5*s*, 5*t* are in contact with the stopper projections 2*o*, 2*p* of the base 2 and thus restricted from moving rightward so that the displacement of the second operational piece 5B is absorbed by the elastic deformation of the springs 12, 13, whereby the position of the operational portion 5*a* of the first operational piece 5A is not changed. This removes the sense of incongruity due to the change in the position of the operational portion 5*a*.

For canceling the engagement between the buckle 1 and the tongue 10, the same operation as the first embodiment as shown in FIGS. 7(*a*) through 7(*e*) is conducted. That is, the operational portion 5*a* is pressed by a finger to move the first operational piece 5A in the leftward direction α and the slider press portions 5*f*, 5*g* of the first operational piece 5A thus press the pressed portions 4*f*, 4*f* of the lock slider 4 (shown in FIG. 9). Accordingly, the lock slider 4 moves in the leftward direction α so that the restraint portions 4*a*, 4*b* are displaced from the upper surfaces of the shoulder portions 3*d*, 3*e* of the latch member 3 so as to allow the latch member 3 to pivot in the counter-clockwise direction γ. Therefore, the ejector 6 pushes out the tongue 10 in the rightward direction ϵ with the spring force of the ejector spring 9 and, at the same time, pushes up the latch member 3 so that the latch member 3 pivots about the shafts 3*a*, 3*b* in the counter-clockwise direction and the joggle portion 3*c* escapes from the latch hole 10*a* of the tongue 10. The tongue 10 is released from the buckle 1 and the lower surface of the joggle portion 3*c* is guided by the inclined guide surface 6*e* of the ejector 6 and then held by the holding portion 6*c* of the ejector 6. As the operational portion 5*a* is released from the finger, the first and second operational pieces 5A, 5B move to the inoperative positions because of the spring force of the button spring 8 and the lock slider 4 moves in the rightward direction ϵ by the spring force of the slider spring 7 so that the restraint portions 4*a*, 4*b* enter into the spaces beneath the shoulder portions 3*d*, 3*e* and the ejector 6 also returns to the inoperative position.

The other operation and effects of the buckle 1 of the second embodiment are the same as those of the first embodiment.

Though the operational button 5, composed of a single member, and the latch member 3, in which the pressed portions 3*f*, 3*g* are disposed on the side opposite to the joggle portion 3*c* in respect to the shafts 3*a*, 3*b*, are combined in the first embodiment while the operational button 5, composed of two members, and the latch member 3, in which the pressed portion 3*f* is disposed on the side of the joggle portion 3*c* in respect to the shafts 3*a*, 3*b*, are combined in the second embodiment, the operational button 5 of the first embodiment and the latch member 3 of the second embodiment may be combined and the operational button 5 of the second embodiment and the latch member 3 of the first embodiment may also be combined.

Figure 15:
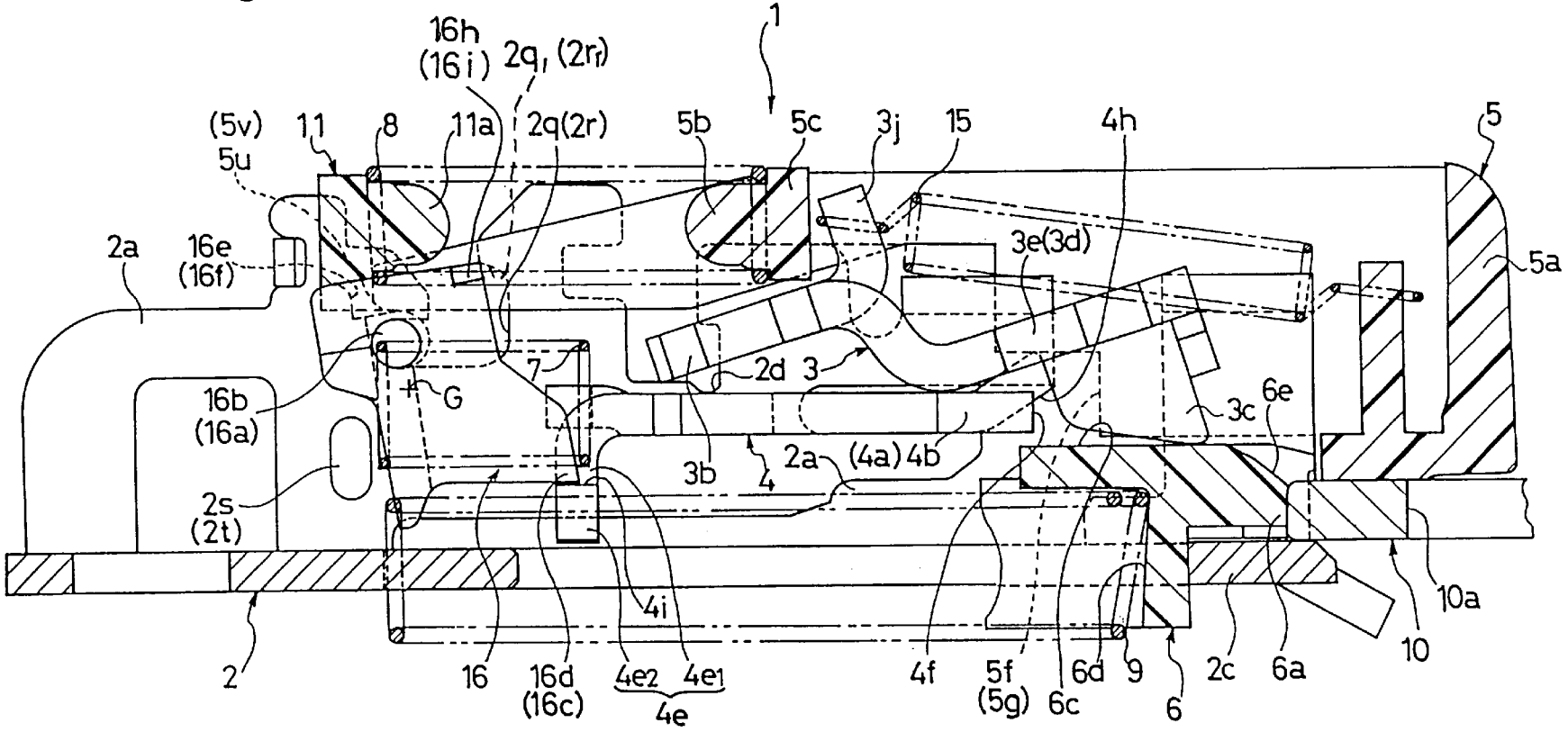
FIG. 15 is a partial sectional view showing a buckle of a third embodiment of the present invention, in its non-engaged state with a tongue.
Figure 16:
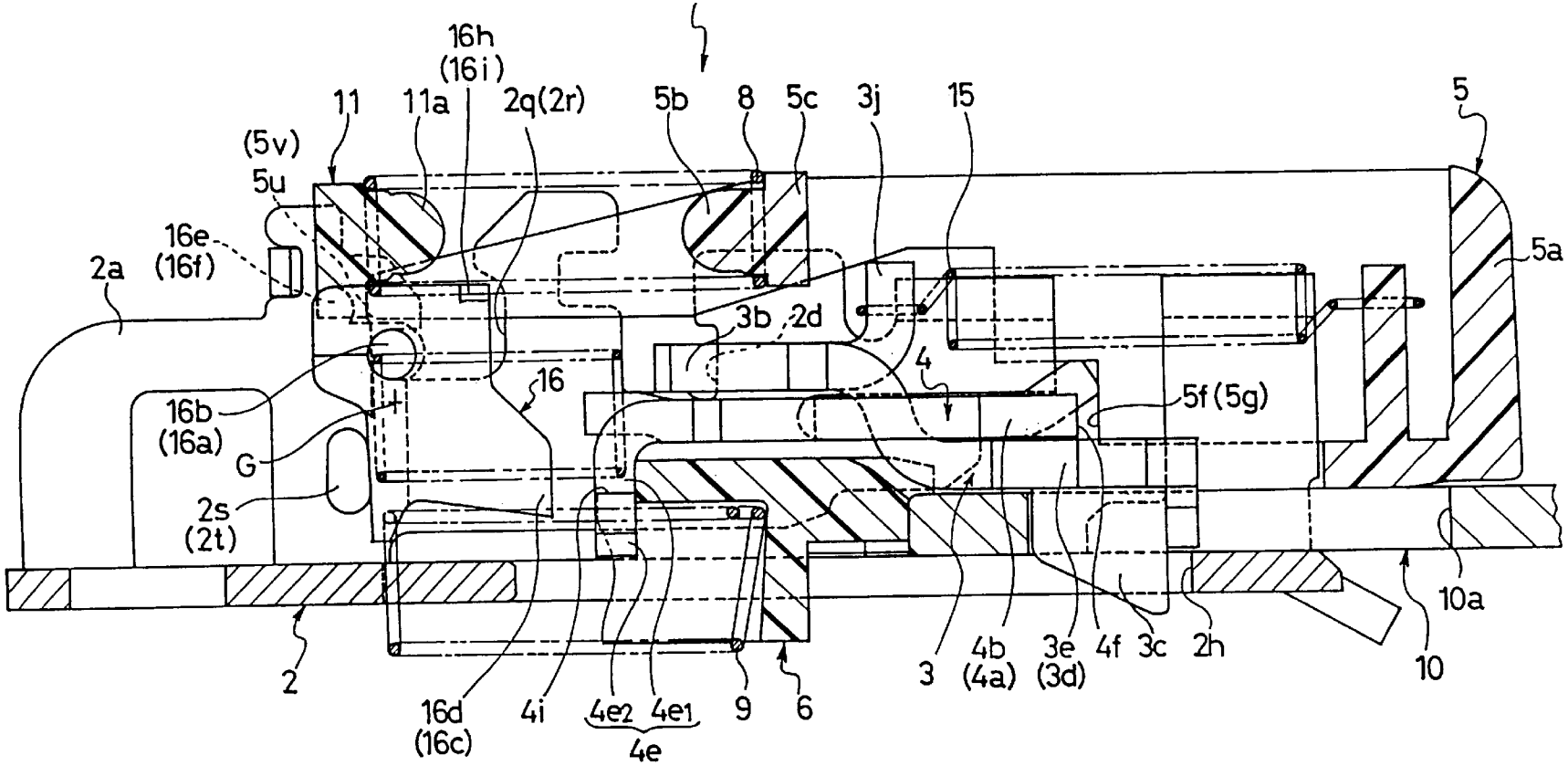
FIG. 16 is a sectional view showing the buckle of FIG. 15, in its engaged state with the tongue.

FIG. 15 is a partial sectional view of a buckle of a third embodiment in its non-engaged state with a tongue and FIG. 16 is a sectional view of the buckle of the third embodiment in its engaged state with the tongue. It should be noted that parts similar or corresponding to the parts of the first and second embodiments will be marked by the same reference numerals so that the detailed description about the parts will be omitted.

In the buckle of the second embodiment mentioned above, the pressed portion 3*f* of the latch member 3 is pressed by the spring force of the button spring 8 via the latch member press portions 5*d*, 5*e* of the operational button 5 whereby the latch member 3 is biased to pivot in the direction of engaging the tongue 10. However, in the buckle 1 of the third embodiment, a latch member biasing spring 15 is compressed between a biased portion 3*j* of a latch member 3 and an operational button 5 as shown in FIGS. 15 and 16 so that the latch member 3 is always biased to pivot in the direction of engaging the tongue 10 by the spring force of the latch member biasing spring 15.

The latch member 3 of the buckle 1 of the third embodiment is formed in substantially the same configuration as the latch member 3 of the second embodiment shown in FIG. 11, but the pressed portion 3*f* of the second embodiment corresponds to the biased portion 3*j* of the latch member 3 of the third embodiment.

Figure 17A:
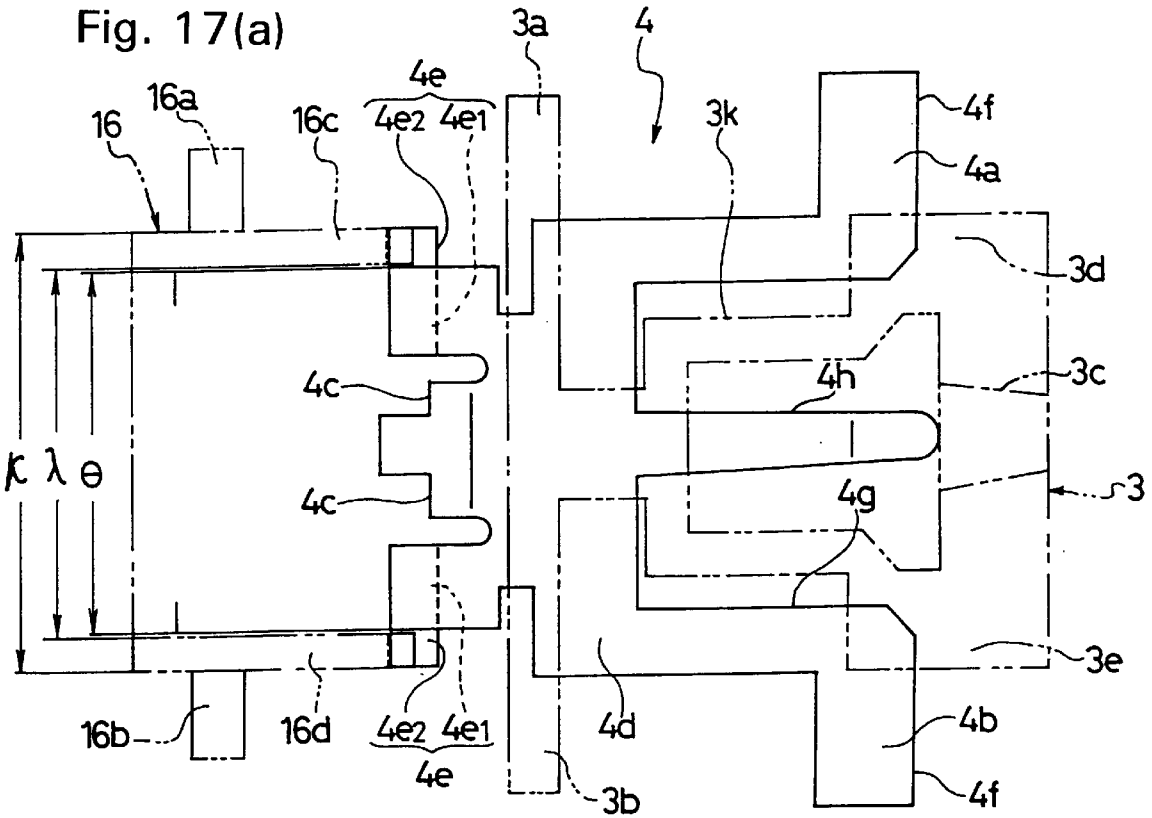
FIG. 17(*a*) is a plan view showing a lock slider employed in the buckle shown in FIG. 15 and FIG. 17(*b*) *is a front view thereof;*
Figure 17B:
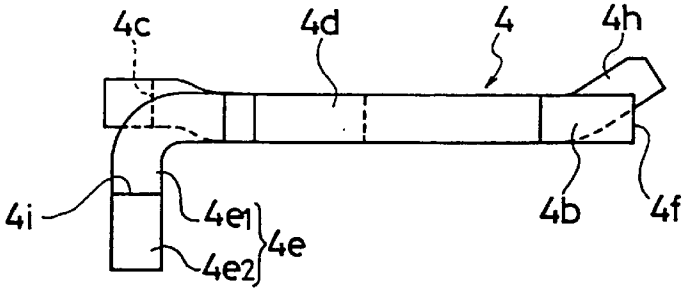

In the lock slider 4 of the buckle 1 of the second embodiment shown in FIG. 12 as mentioned above, the restraint portions 4*a*, 4*b* and the main body 4*d* are formed to have respective surfaces of different levels. However, in a lock slider 4 of the buckle 1 of the third embodiment, the restraint portions 4*a*, 4*b* and the main body 4*d* are formed to have surfaces of the same level as shown in FIGS. 17(*a*) and 17(*b*). Accordingly, the height of the whole of the lock slider 4 in the vertical direction in FIG. 17(*b*) is shorter than that of the lock slider 4 of the second embodiment. As shown in FIG. 15, therefore, the buckle 1 of the third embodiment is more compact in the vertical direction than the buckles 1 of the first and second embodiments.

In the non-engaged state where the buckle 1 and the tongue 10 are not engaged as shown in FIG. 15, the lock slider 4 as a whole is positioned beneath the shafts 3*a*, 3*b* and the shoulder portions 3*d*, 3*e* of the latch member 3. In the engaged state where the buckle 1 and the tongue 10 are engaged as shown in FIG. 16, the restraint portions 4*a*, 4*b* and one part of the main body 4*d* of the lock slider 4 are positioned above the shoulder portions 3*d*, 3*e* of the latch member 3 and the spring supporting portion 4*c* and the other part of the main body 4*d* are positioned beneath the shafts 3*a*, 3*b* of the latch member 3.

Because the restraint portions 4*a*, 4*b* and the main body 4*d* are arranged in the same level and the restraint portions 4*a*, 4*b* of the lock slider 4 are positioned beneath the shoulder portions 3*d*, 3*e* of the latch member 3 in the non-engaged state where the buckle 1 and the tongue 10 are not engaged while the restraint portions 4*a*, 4*b* are positioned above the shoulder portions 3*d*, 3*e* of the latch member 3 in the engaged state where the buckle 1 and the tongue 10 are engaged, the lock slider 4 has a large concavity 4*g* between the restraint portions 4*a* and 4*b* as shown in FIG. 17(*a*). A main body 3*k* of the latch member 3 between the shafts 3*a*, 3*b* and the shoulder portions 3*d*, 3*e* can pass through this concavity 4*g* as shown by chain double-dashed lines in FIG. 17(*a*). In addition, the lock slider 4 is provided with a stopper 4*h* extending within the concavity 4*g* and the right end of the stopper 4*h* is bent slightly upwardly. In the non-engaged state where the buckle 1 and the tongue 10 are not engaged as shown in FIG. 15, the right end of the stopper 4*h* is in contact with the left end of the joggle portion 3*c* of the latch member 3 which is in the upper or non-engaged position, thereby restricting the lock slider 4, which is biased rightward by the slider spring 7, from moving to the right. In the engaged state where the buckle 1 and the tongue 10 are engaged as shown in FIG. 16, the right end of the stopper 4*h* is not in contact with the left end of the joggle portion 3*c* of the latch member 3 which is in the lower or engaged position, thereby allowing the lock slider 4 to move to the right because of the spring force of the slider spring 7.

The lock slider 4 has ejector-contact portions 4*e*, 4*e*, each of which comprises an upper part $4e_1$ and a lower part $4e_2$ in FIG. 17(*b*). The width θ formed by two of the upper parts $4e_1$, $4e_1$ and the width κ formed by two of the lower parts $4e_2$, $4e_2$ (θ<κ; shown in FIG. 17(*a*)) are different from each other so that there are steps 4*i*, 4*i* between the upper parts $4e_1$, $4e_1$ and a lower parts $4e_2$, $4e_2$, respectively.

Figure 18B:
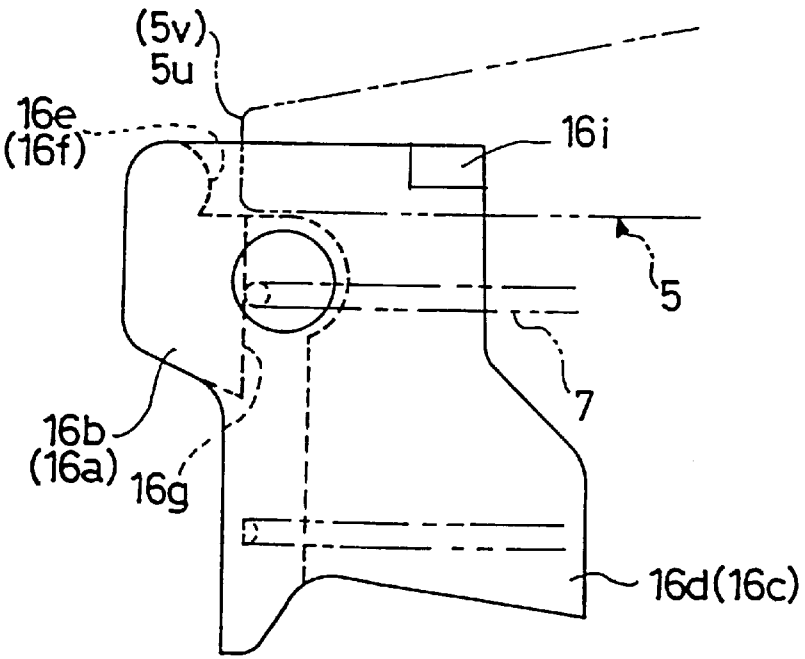
FIG. 18(*a*) is a plan view showing an inertia lever employed in the buckle shown in FIG. 15 and FIG. 18(*b*) is a front view thereof.
Figure 18A:
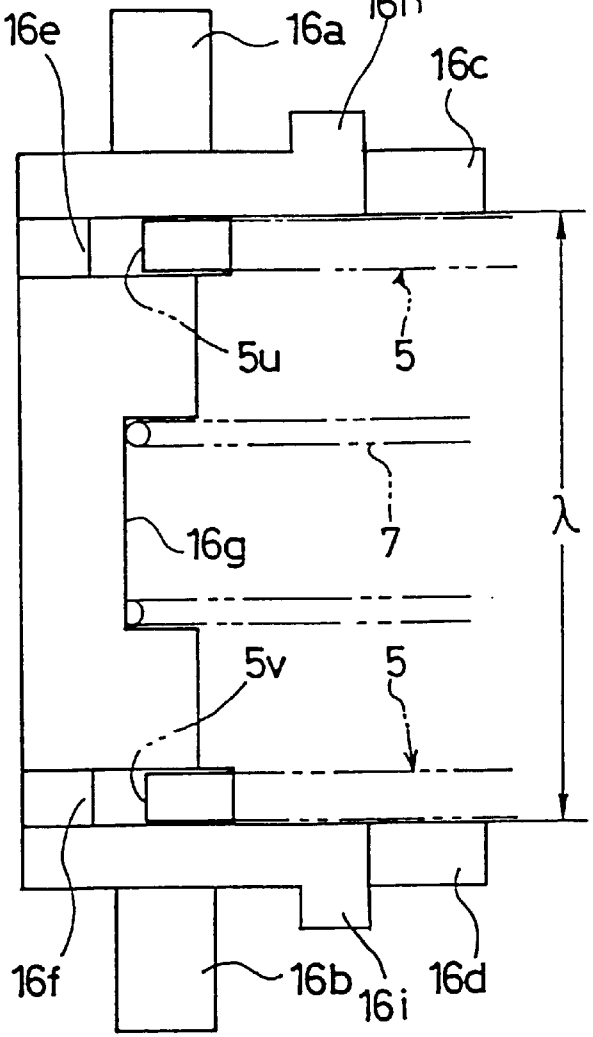

As shown in FIG. 15 and FIG. 16, disposed in front of the lock slider 4 is an inertia lever 16. As shown in FIGS. 18(*a*) and 18(*b*), the inertia lever 16 is provided with rotation shafts 16*a*, 16*b* which are coaxial to each other. The rotation shafts 16*a*, 16*b* are hung and supported by grooves 2*q*, 2*r* formed in the side walls 2*a*, 2*b* in such a manner as to allow the inertia member 16 to rotate and to move in the right and left directions as shown in FIG. 15. That is, the inertia lever 16 is able to rotate about the rotation shafts 16*a*, 16*b* and move in the right and left directions.

The inertia lever 16 has a pair of stoppers 16*c*, 16*d* disposed to lower end portions on the side of lock slider 4 in such a manner that the distance between the stoppers 16*c*, 16*d* is a predetermined distance λ. As shown in FIG. 18(*a*) the predetermined distance λ between the stoppers 16*c*, 16*d* is set to be larger than the width θ formed by the upper parts $4e_1$, $4e_1$ of the ejector-contact portions 4*e*, 4*e* and smaller than the width κ formed by the lower part $4e_2$, $4e_2$ of the ejector-contact portions 4*e*, 4*e*. This means that the upper parts $4e_1$, $4e_1$ of the ejector-contact portions 4*e*, 4*e* are able to enter into the space between the stoppers 16*c*, 16*d* while the lower parts $4e_2$, $4e_2$ of the ejector-contact portions 4*e*, 4*e* come in contact with the stoppers 16*c*, 16*d* and are not able to enter into the space between the stoppers 16*c*, 16*d*.

The inertia lever 16 has pressed portions 16*e*, 16*f*. The operational button 5 has inertia lever press portions 5*u*, 5*v* which can come in contact with the pressed portions 16*e*, 16*f*. When the operational button 5 is moved in the direction (leftward in FIG. 15) of canceling the engagement between the buckle 1 and the tongue 10 at a normal operational speed, the inertia lever press portions 5*u*, 5*v* come in contact with the pressed portions 16*e*, 16*f* to press the pressed portions 16*e*, 16*f* so that the inertia lever 16 rotates about the rotation shafts 16*a*, 16*b* in the counter-clockwise direction in FIG. 15.

The inertia lever 16 is also provided with a spring supporting portion 16*g* for supporting a slider spring 7 which is compressed between this spring supporting portion 16*g* and the spring supporting portion 4*c* of the lock slider 4. The inertia lever 16 is always biased in the clockwise direction in FIG. 15 by the spring force of the slider spring 7. The inertia lever 16 is further provided with stoppers 16*h*, 16*i* which can come in contact with jaws $2q_1$, $3r_1$ of the groove 2*q*, 2*r* of the side walls 2*a*, 2*b*, as will be described later.

The side walls of the base 2 are provided with inertia lever stoppers 2*s*, 2*t* projecting inwardly. When the inertia lever 16 rotates in the clockwise direction, the inertia lever 16 come in contact with the inertia lever stoppers 2*s*, 2*t* and is thereby prevented from further rotating in the clockwise direction.

In the buckle 1 of the third embodiment, the left end of the base 2 is connected to a buckle pre-tensioner (not shown) which is well known in the art. The buckle pre-tensioner actuates in an emergency such as in the event of vehicle collision to retract the buckle 1, thereby rapidly increasing the force for restraining a belt wearer by the seat belt.

Just after the buckle 1 is retracted by the buckle pre-tensioner, inertia force exerts on the buckle 1 in the leftward direction as will be described later. At this point, the operational button 5 is moved by this inertia force and the inertia lever press portions 5*u*, 5*v* come in contact with the pressed portions 16*e*, 16*f* of the inertia lever 16 so that the inertia force of the operational button 5 produces first torque on the inertia lever 16 to rotate the inertia lever 16 in the counter-clockwise direction. On the other hand, the aforementioned inertia force is also exerted on the inertia lever so that the inertia force of the inertia lever 16 and the weight of the inertia lever 16 produce together second torque on the inertia lever 16 to rotate the inertia lever 16 in the clockwise direction. In this case, the second torque is set to be larger than the first torque, whereby the inertia lever 16 rotates in the clockwise direction.

The operational button 5 of the third embodiment is composed of a single member just like the operational button 5 of the first embodiment, not two members just like the first and second operational pieces 5A, 5B of the operational button 5 of the second embodiment.

The other structure of the buckle 1 of the third embodiment is the same as that of the second embodiment.

As for the buckle 1 of the third embodiment as structured above, in the non-engaged state with the tongue 10, the restraint portions 4*a*, 4*b* of the lock slider 4 are positioned beneath the shoulder portions 3*d*, 3*e* of the latch member 3 as shown in FIG. 15 in the same manner as the other embodiments. The latch member 3 is in the upper or non-engaged position where the joggle portion 3*c* is supported by the upper surface of the ejector 6. Further, the right end of the stopper 4*h* of the lock slider 4 is in contact with the left end of the joggle portion 3*c* of the latch member 3 and the lock slider 4 is restricted from rightward movement in spite of the spring force of the slider spring 7. Parts of the upper parts $4e_1$, $4e_1$ of the ejector-contact portions 4*e*, 4*e* of the lock slider 4 enter into the space between the stoppers 16*c* and 16*d* of the inertia lever 16. At this point, the stoppers 16*c*, 16*d* of the inertia lever 16 are in contact with the steps 4*i*, 4*i* formed between the upper parts $4e_1$, $4e_1$ and the lower parts $4e_2$, $4e_2$ of the ejector-contact portions 4*e*, 4*e* because of the spring force of the slider spring 7 so that the inertia lever 16 is restricted from further rotation in the clockwise direction. That is, the inertia lever 16 is set in the position allowing the lock slider 4 to move to the position capable of canceling the engagement between the tongue 10 and the latch member 3.

In this state, the tongue 10 is inserted into the buckle 1 so that the ejector 6 moves with the tongue 10 to the left to come in contact with the ejector-contact portions 4*e*, 4*e* of the lock slider 4, in the same manner as the first embodiment shown in FIGS. 6(*a*) through 6(*e*). As the tongue 10 is further inserted into the buckle 1, the lock slider 4 slides in the longitudinal (leftward) direction of the buckle 1 by the ejector 6. The restraint portions 4*a*, 4*b* of the lock slider 4 is displaced from the position beneath the shoulder portions 3*d*, 3*e* of the latch member 3 and the latch member 3 pivots about the shafts 3*a*, 3*b* in the clockwise direction by the spring force of the latch spring 15 to the engaged position shown in FIG. 16. As a result of this, the joggle portion 3*c* enters into the latch hole 10*a* of the tongue 10. In this manner, the tongue 10 is engaged and connected to the buckle 1.

At this point, the right end of the stopper 4*h* of the lock slider 4 is displaced from the left end of the joggle portion 3*c* of the lock member 3 so that the lock slider 4 slides rightward from the position in the non-engaged state shown in FIG. 15 because of the spring force of the slider spring 7. Then, the restraint portions 4*a*, 4*b* of the lock slider 4 are positioned above the shoulder portions 3*d*, 3*e* of the latch member 3, whereby the pivotal movement of the latch member 3 in the counter-clockwise direction is prevented by the restraint portions 4*a*, 4*b* so that the latch member 3 is locked in the engaged position.

Because the lock slider 4 slides to the right than the position in the non-engaged state shown in FIG. 15, the upper parts $4e_1 4e_1$ of the ejector-contact portions 4*e*, 4*e* of the lock slider 4 escape from the space between the stoppers 16*c* and 16*d* of the inertia lever 16 so that the stoppers 16*c*, 16*d* are released from the steps 4*i*, 4*i* of the ejector-contact portions 4*e*, 4*e*. The inertia lever 16 thus rotates in the clockwise direction because of the spring force of the slider spring 7. Then, the inertia lever 16 comes in contact with the inertia lever stoppers 2*s*, 2*t* of the side walls 2*a*, 2*b*, thereby restricting its further rotation in the clockwise direction. That is, the inertia lever 16 is set in the position preventing the lock slider 4 from moving to the position capable of canceling the engagement between the tongue 10 and the latch member 3.

In this way, the buckle 1 of the third embodiment becomes in the engaged state with the tongue 10 as shown in FIG. 16.

The operation for canceling the engagement between the buckle 1 and the tongue 10 is substantially the same as that of the first embodiment shown in FIGS. 7(*a*) through 7(*e*). That is, the operational portion 5*a* of the operational button 5 is pressed by a finger to move the operational button 5 leftward. In the buckle 1 of the third embodiment, by the leftward movement of the operational button 5, the inertia lever press portions 5*u*, 5*v* of the operational button 5 come in contact with the pressed portions 16*e*, 16*f* and press them, respectively. The inertia lever 16 then starts its rotation in the counter-clockwise direction. In the same manner as the first and second embodiments, the slider press portions 5*f*, 5*g* of the operational button 5 thus come in contact with the pressed portions 4*f*, 4*f* of the lock slider 4 and press them. Accordingly, the lock slider 4 moves in the leftward direction of the buckle 1.

At this point, the ejector-contact portions 4*e*, 4*e* of the lock slider 4 come closer to the inertia lever 16. Before the lower parts $4e_2$, $4e_2$ of the ejector-contact portions 4*e*, 4*e* come in contact with the stoppers 16*c*, 16*d* of the inertia lever 16, the lower ends of the stoppers 16*c*, 16*d* are positioned above the steps 4*i*, 4*i* of the ejector-contact portions 4*e*, 4*e* so that the upper parts $4e_1$, $4e_1$ of the ejector-contact portions 4*e*, 4*e* are in the state capable of entering to the space between the stoppers 16*c* and 16*d*.

As the operational button 5 is moved further to the left, the upper parts $4e_1$, $4e_1$ of the ejector-contact portions 4*e*, 4*e* enter in the space between the stoppers 16*c* and 16*d* so that the restraint portions 4*a*, 4*b* of the lock slider 4 are displaced from the position above the shoulder portions 3*d*, 3*e* of the latch member 3, thereby allowing the latch member 3 to pivot in the counter-clockwise direction. Therefore, the ejector 6 pushes out the tongue 10 to the right with the spring force of the ejector spring 9 and, at the same time, pushes up the latch member 3 so that the latch member 3 pivots about the shafts 3*a*, 3*b* in the counter-clockwise direction and the joggle portion 3*c* escapes from the latch hole 10*a* of the tongue 10. In addition, the tongue 10 is released from the buckle 1, the lower surface of the joggle portion 3*c* is guided by the inclined guide surface 6*e* of the ejector 6 and is then held by the holding portion 6*c* of the ejector 6, thereby making the latch member 3 in the non-engaged position. The ejector 6 comes in contact with the right end of the elongated hole 2*h* of the base 2 and becomes in the inoperative position.

As the operational portion 5*a* is released from the finger, the operational button 5 moves to the right or inoperative position by the spring force of the button spring 8 so that the inertia lever press portions 5*u*, 5*v* of the operational button 5 are spaced apart from the pressed portions 16*e*, 16*f* of the inertia lever 16. Then, the inertia lever 16 rotates in the clockwise direction because of the spring force of the slider spring 7 so that the lower ends of the stoppers 16*c*, 16*d* come in contact with the steps 4*i*, 4*i* of the ejector-contact portions 4*e*, 4*e*. At the same time, the lock slider 4 moves to the right because of the spring force of the slider spring 7 so that the right end of the stopper 4*h* comes in contact with the left end of the joggle portion 3*c* of the latch member 3. Accordingly, the restraint portions 4*a*, 4*b* of the lock slider 4 are positioned right beneath the shoulder portions 3*d*, 3*e* of the latch member 3. In this manner, the buckle 1 of the third embodiment becomes in the non-engaged state with the tongue 10 shown in FIG. 15.

By the way, the buckle pre-tensioner is actuated in the event of emergency such as a vehicle collision in the state where the occupant wears the seat belt i.e. the buckle 1 and the tongue 10 are engaged as shown in FIG. 16, whereby the base 2 is rapidly retracted to the left. Significantly large leftward acceleration is exerted on the buckle 1 so that rightward inertia force is produced in the buckle 1. At this point, the movable components of the buckle 1 except the inertia lever 16 are locked from moving rightward, while the inertia lever 16 is allowed to move rightward and pivot in the counter-clockwise direction. During the buckle 1 is retracted by the buckle pre-tensioner, therefore, only the inertia lever 16 moves rightward by the inertia force acting on its center of gravity G so that the pressed portions 16*e*, 16*f* of the inertia lever 16 come in contact with the inertia lever press portions 5*u*, 5*v* of the operational button 5. After that, the inertia lever 16 tends to further move to the right whereby the inertia lever 16 pivots about its contact portions in the counter-clockwise direction in FIG. 19 until the stoppers 16*h*, 16*i* of the inertia lever 16 comes in contact with the jaws $2q_1$, 2*r*, of the grooves 2*q*, 2*r* of the side walls 2*a*, 2*b* and becomes in the state shown in FIG. 19.

Figure 19:
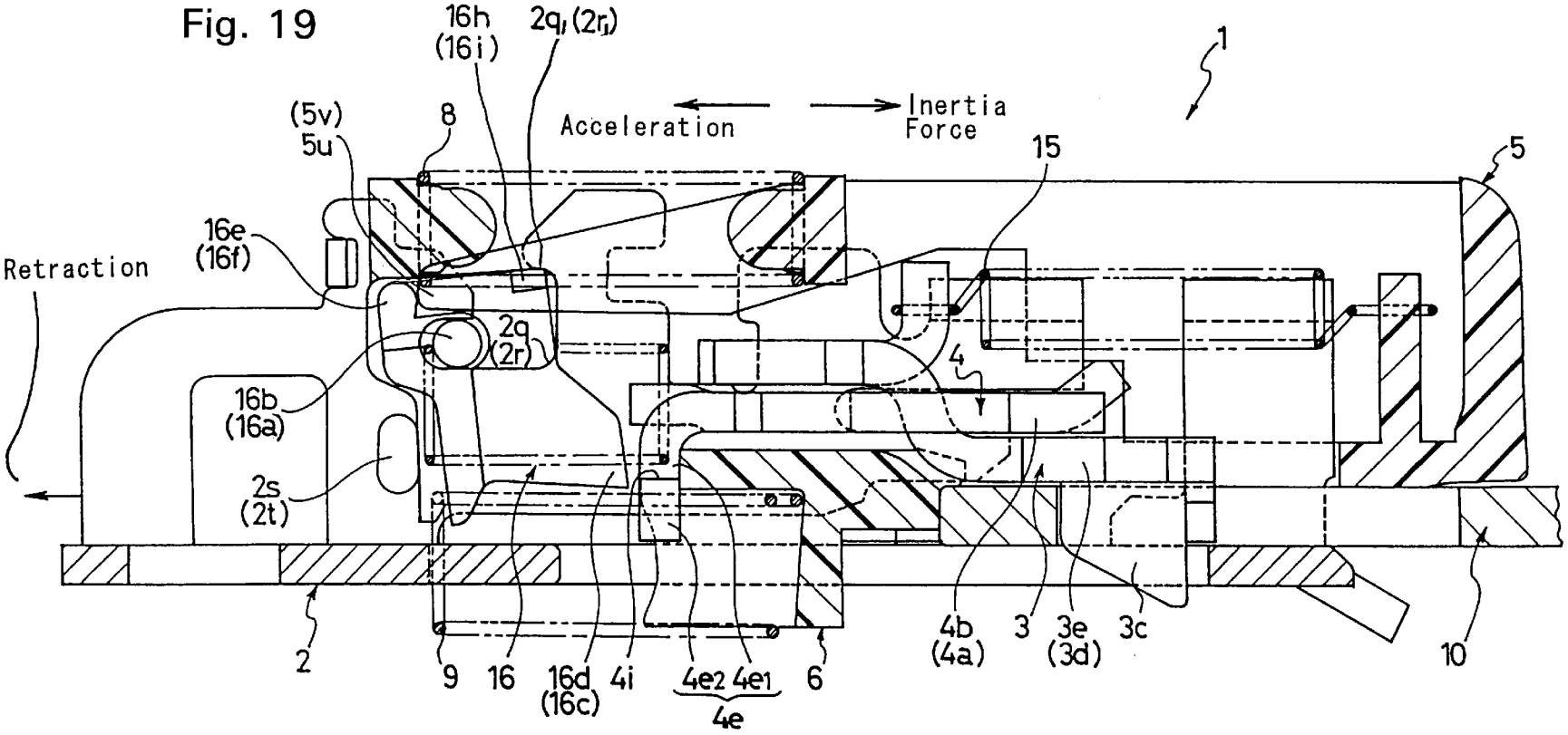
FIG. 19 is a partial sectional view showing the buckle shown in FIG. 15 in the process of retraction by a pretensioner.

Just after the retraction of the buckle 1 by the buckle pre-tensioner is terminated, to the contrary, large leftward inertia force is applied to the buckle 1 in the state shown in FIG. 19. Then, by the inertia force, the operational button 5 and the inertia lever 16 move leftward, and the rotation shafts 16*a*, 16*b* of the inertia lever 16 come in contact with the left ends of the grooves 2*q*, 2*r* of the side walls 2*a*, 2*b* again, that is, return to the initial state. However, the operational button 5 is biased by inertia force to move leftward so that the inertia lever press portions 5*u*, 5*v* press the pressed portions 16*e*, 16*f* to the left. The first torque in the counter-clockwise direction acts on the inertia lever 16. However, at this point, since leftward inertia force acting on its center of gravity G is also exerted on the inertia lever 16, the torque by the inertia force in the clockwise direction and the weight of the inertia lever 16 produce together the second torque which is also exerted on the inertia lever 16. Since the second torque is larger than the first torque, the inertia lever 16 rotates in the clockwise direction so as to come in contact with the stoppers 2*s*, 2*t* of the side walls 2*a*, 2*b*. Thus, the inertia lever 16 is set in the position restricting the lock slider 4 from moving to the position capable of canceling the engagement between the tongue 10 and the latch member 3.

In this state, the lock slider 4 is also subjected to large leftward inertia force and thus slides to the left i.e. the position of releasing the lock. Since the lower parts $\mathbf{4}e_2$, $\mathbf{4}e_2$ of the ejector-contact portions 4*e*, 4*e* come in contact with the stoppers 16*c*, 16*d* of the inertia lever 16, thereby restricting the lock slider 4 from further moving to the left. That is, the lock slider 4 is prevented from moving to the position of releasing the lock. Therefore, the disengagement between the buckle 1 and the tongue 10 just after the actuation of the buckle pre-tensioner can be securely prevented, thereby preventing the tongue 10 from coming off the buckle 1 due to the inertia caused by the actuation of the buckle pre-tensioner.

The other operation and effects of the buckle 1 of the third embodiment are the same as those of the first and second embodiments.

Figure 20:
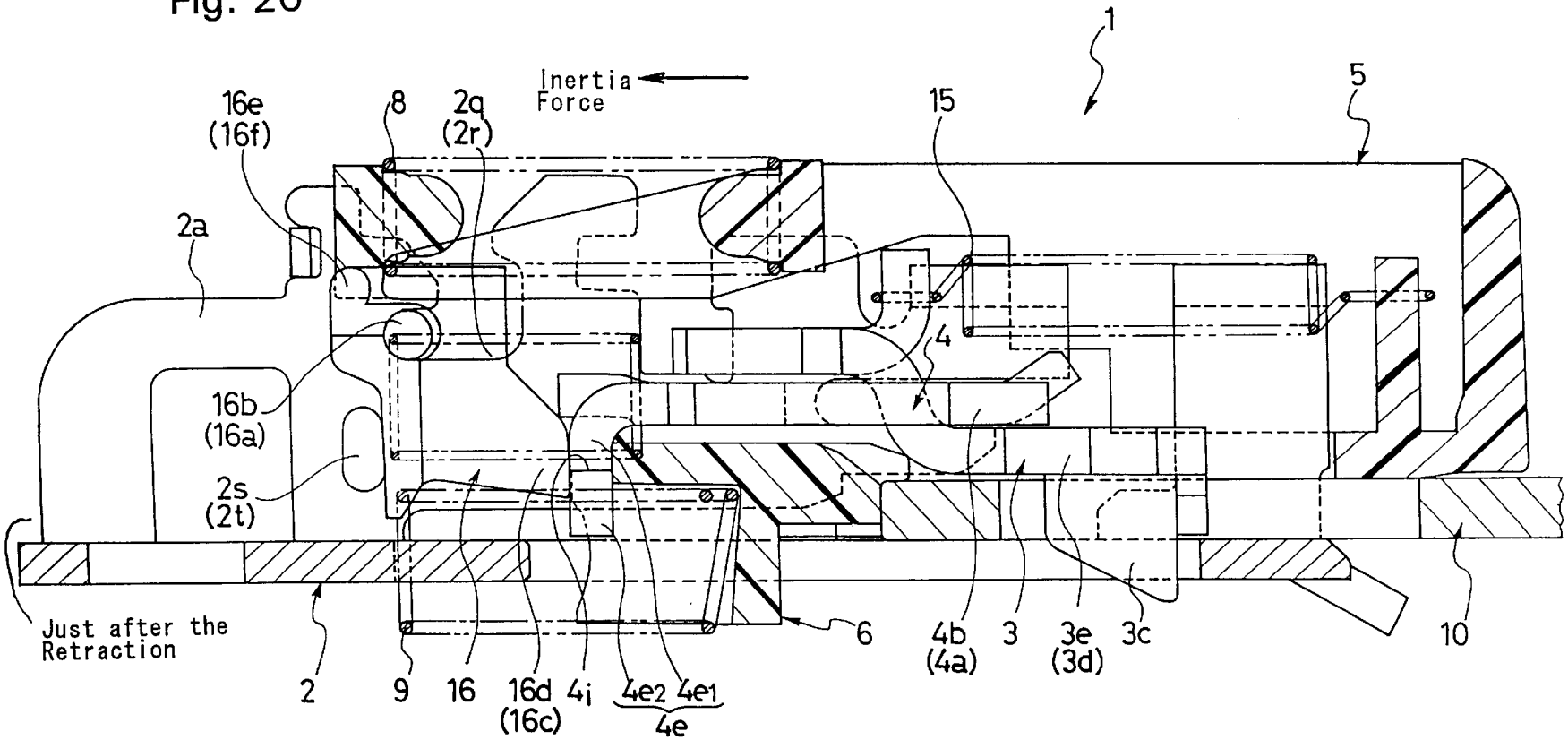
FIG. 20 is a partial sectional view showing the buckle shown in FIG. 15 just after the retraction by the pretensioner.

In FIG. 19 and FIG. 20, within a range including the inertia lever press portions 5*u*, 5*v* of the operational button 5 and the pressed portions 16*e*, 16*f* of the inertia lever 16, portions which should be illustrated by chain lines normally are illustrated by solid lines in order to clearly show the relation of engagement.

Though the operational button 5 is composed of a single member in the buckle 1 of the third embodiment, the operational button may be composed of two members just like the buckle of the second embodiment.

As apparent from the above description, in the buckle of the present invention, the lock member which controls the lock of the latch member is designed to move linearly only in the longitudinal direction of the buckle so that the movement of the lock member is significantly simple and thus smooth as compared to the movement of the conventional lock member which both pivots and moves linearly. This improves the controllability of the latch member.

Particularly, according to the present invention, the force acting on the joggle portion can be set to be closer to the biasing force biasing the latch member and the length of the latch member in the longitudinal direction can be shortened.

Further, according to the present invention, even when the position of the pressed portion of the latch member is changed between the non-engaged state and the engaged state, the position of the first operational piece which the seat belt user directly touches can be prevented from being changed.

Furthermore, according to the present invention, even when the lock member is subjected to acceleration, such as acceleration produced just after the actuation of the buckle pre-tensioner, which acts to move the lock member to the position capable of canceling the engagement between the tongue and the latch member, the disengagement between the buckle and the tongue can be securely prevented. This achieves the prevention of the tongue from coming off the buckle due to the inertia caused by the actuation of the buckle pre-tensioner.

What we claim is:

1. A buckle comprising:

a base having side walls;

a latch member which is supported by the side walls so that the latch member can pivot between its non-engaged position and its engaged position, said latch member being biased to said engaged position, and pivoting to the engaged position when a tongue is inserted into a predetermined position, so as to engage the tongue;

an operational member which is manipulated to cancel an engagement between said tongue and said latch member; and a lock member which holds said latch member to said engaged position when said tongue and said latch member are engaged and is able to be moved by said operational member to a position capable of canceling the engagement between said tongue and said latch member, said lock member being arranged to move only in a longitudinal direction of said buckle and including at least one restraint portion which is positioned beneath said latch member when said latch member is in said non-engaged position and is positioned above said latch member when said latch member is in said engaged position, said restraint portion preventing said latch member from pivoting to said non-engaged position when said restraint portion is positioned above said latch member.

2. A buckle comprising:

a base having side walls;

a latch member which is supported by the side walls so that the latch member can pivot between its non-engaged position and its engaged position, said latch member being biased to said engaged position, and pivoting to the engaged position when a tongue is inserted into a predetermined position, so as to engage the tongue, said latch member including a shaft which is inserted in and rotatably supported by said side walls, a joggle portion capable of engaging said tongue, and a pressed portion disposed between said shaft and the joggle portion which is subjected to biasing force to said engaged positions;

an operational member which is manipulated to cancel an engagement between said tongue and said latch member; and a lock member which holds said latch member to said engaged position when said tongue and said latch member are engaged and is able to be moved by said operational member to a position capable of canceling the engagement between said tongue and said latch member, said lock member being arranged to move only in a longitudinal direction of said buckle.

3. A buckle comprising:

a base having side walls;

a latch member which is supported by the side walls so that the latch member can pivot between its non-engaged position and its engaged position, said latch member being biased to said engaged position, and pivoting to the engaged position when a tongue is inserted into a predetermined position, so as to engage the tongue;

an operational member which is manipulated to cancel an engagement between said tongue and said latch member, said operational member including a first operational piece and a second operational piece which is disposed movably relative to said first operational piece to bias a pressed portion of said latch member to said engaged position of said latch member; and a lock member which holds said latch member to said engaged position when said tongue and said latch member are engaged and is able to be moved by manipulation of said first operational piece of the operational member to a position capable of canceling the engagement between said tongue and said latch member, said lock member being arranged to move only in a longitudinal direction of said buckle.

4. The buckle as claimed in claim 3, further comprising an elastic means disposed between said first operational piece and said second operational piece.

5. A buckle comprising:

a base having side walls;

a latch member which is supported by the side walls so that the latch member can pivot between its non-engaged position and its engaged position, said latch member being biased to said engaged position, and pivoting to the engaged position when a tongue is inserted into a predetermined position, so as to engage the tongue;

an operational member which is manipulated to cancel an engagement between said tongue and said latch member;

a lock member which holds said latch member to said engaged position when said tongue and said latch member are engaged and is able to be moved by said operational member to a position capable of canceling the engagement between said tongue and said latch member, said lock member being arranged to move only in a longitudinal direction of said buckle; and an inertia member which comes in contact with said lock member to restrict said lock member from moving to the position capable of cancelling the engagement between said tongue and said latch member when said lock member is subjected to such acceleration as to move said lock member to the position capable of cancelling the engagement between said tongue and said latch member.

6. The buckle as claimed in claim 5, wherein said inertia member comprises an inertia lever which is rotatably disposed to said side walls of said base so that said inertia lever can rotate between a position where it restricts said lock member from moving to the position capable of canceling the engagement between said tongue and said latch member and a position where it allows said lock member from moving to the position capable of canceling the engagement between said tongue and said latch member.

7. The buckle as claimed in claim 6, wherein a rotation of said inertia lever to move said lock member to the position capable of canceling the engagement between said tongue and said latch member is achieved by said operational member, said inertia lever is biased to rotate to the position allowing said lock member to move to the position capable of canceling the engagement between said tongue and said latch member by first torque which is produced by said operational member pressing said inertia lever with inertia force acting on said operational member by said acceleration, and said inertia lever is biased to rotate to the position restricting said lock member to move the position capable of canceling the engagement between said tongue and said latch member by second torque produced by inertia force acting on said inertia lever by said acceleration and the weight of said inertia lever, wherein said second torque is set to be larger than said first torque.

* * * * *